US007980568B2

(12) United States Patent
Chen

(10) Patent No.: US 7,980,568 B2
(45) Date of Patent: Jul. 19, 2011

(54) WHEEL SKATE DEVICE

(76) Inventor: Shane Chen, Camas, WA (US)

( * ) Notice: Subject to any disclaimer, the term of this patent is extended or adjusted under 35 U.S.C. 154(b) by 509 days.

(21) Appl. No.: 11/966,962

(22) Filed: Dec. 28, 2007

(65) Prior Publication Data

US 2008/0272567 A1 Nov. 6, 2008

Related U.S. Application Data

(60) Provisional application No. 60/926,760, filed on Apr. 30, 2007, provisional application No. 60/958,347, filed on Jul. 3, 2007.

(51) Int. Cl.
*A63C 17/08* (2006.01)

(52) U.S. Cl. ..... 280/11.24; 280/87.042; 280/87.05

(58) Field of Classification Search ..... 280/11.24, 280/11.25, 11.26, 87.01–87.05
See application file for complete search history.

(56) References Cited

U.S. PATENT DOCUMENTS

| | | | | |
|---|---|---|---|---|
| 6,196,558 | B1 * | 3/2001 | Simon | 280/14.22 |
| 6,382,640 | B1 * | 5/2002 | Killian | 280/11.24 |
| 6,705,630 | B1 * | 3/2004 | Karpman | 280/253 |
| 7,059,613 | B2 | 6/2006 | Farrelly | |
| 7,150,461 | B2 * | 12/2006 | Schnuckle et al. | 280/87.05 |
| 2006/0186617 | A1 * | 8/2006 | Farrelly et al. | 280/8 |

* cited by examiner

*Primary Examiner* — J. Allen Shriver, II
*Assistant Examiner* — Katy Meyer
(74) *Attorney, Agent, or Firm* — Steven J. Adamson

(57) ABSTRACT

Two skate wheel devices each with a foot placement platform, a frame and a wheel. The wheel rotates relative to the frame. The user inserts both feet into respective platforms within the skate wheel devices while the devices rest on pavement. After shifting weight to one of the wheel skate devices, the other raised so that the foot is generally horizontal as opposed to pointing to the pavement. The wheel skate device with the raised foot is then rolled to the side. The user then raises the other wheel skate device so that its foot also points generally horizontally and rolls that wheel skate device in the same direction as the other to build momentum. The platform may rock back and forth relative to the wheel. Grooved rollers may be sandwiched between spaced apart frame elements.

23 Claims, 33 Drawing Sheets

WHEEL SKATE DEVICE

CROSS REFERENCE TO COPENDING PATENT APPLICATIONS

The application claims the benefit of priority from provisional patent application Ser. No. 60/926760 filed Apr. 30, 2007 and provisional patent application Ser. No. 60/958,347 filed Jul. 3, 2007.

BACKGROUND OF THE INVENTION

The present invention relates to human powered wheeled transportation devices that encircle the foot of the user during use.

U.S. Pat. No. 6,705,630 describes a human powered wheeled transportation device that uses wheel skates each encircling the foot of the user during use. Each of the wheel skates has a respective wheel, an inner circular rim and an outer circular rim spaced from the inner circular rim by bearings. The inner circular rim supports a foot placement platform. A pivot link extends between the inner circular rims of two wheel skates to connect them together. Such has the effect of constraining the foot placement platform against moving relative to the frame so as to keep the inner circular rims and thereby the foot placement platforms stationary. The pivot link enables the user to keep just one foot in one of the foot placement platforms while resting the other foot on the frame if desired.

U.S. Pat. No. 7,059,613 also describes a human powered wheeled transportation device that that permits independent foot movement with two small wheels provided under a user's foot. However, no wheel encircles the user's foot.

It would be desirable to provide a human powered wheeled transportation devices that encircle the foot of the user during use and yet provided for independent foot movement.

SUMMARY OF THE INVENTION

One aspect of the invention resides in a human powered wheeled transportation device, i.e., a wheel skate device that encircles the foot of the user during use and yet provides for independent foot movement. The device may include a frame with two spaced apart frame elements, rotary couplings in the space between the two frame elements, at least one wheel arranged on the rotary couplings to rotate relative to the frame, and a foot placement platform. The platform projects outwardly from the frame to accommodate placement of a user's foot thereon and may be part of the base of a boot. The frame and the platform may rotate in unison with each other back and forth about the wheel axis relative to the at least one wheel. The rotary couplings may be bearings or wheels. The platform extends beneath an axial rotational center of the wheel.

The wheel skate device is preferably free of any constraint that would substantially prevent the platform (or the frame to which the platform is attached) from rocking back and forth relative to the at least one wheel, that is, beyond an extent otherwise permitted due to tolerance in manufacture and arrangement of the wheel, frame and platform. For instance, the pivot link of U.S. Pat. No. 6,705,630 is inflexible in a vertical direction under operation on pavement and substantially prevents rocking back and forth of its foot placement platform relative to its wheel.

If desired, the foot placement platform may pivot within a plane that is parallel to a surface of the foot placement platform on which a foot is placed. Further pivoting may allow the platform to be moved between operative and stowed positions. Alternatively, he foot placement platform may be detachable from the frame to be moved between the operative position and the stowed position.

In use, a user places both feet on respective foot placement platforms while two skates are on the ground such as a paved roadway. The user moves sideways by alternating the feet in a forward and backward motion separately, and twisting both feet inward and outward upon initiating the forward and backward motion. However, if the foot placement platform is secured to the frame so that the foot placement platform can pivot, then there is no need to twist both feet inward and outward upon the initiating of the forward and backward motion of the feet separately. Instead, the wheels pivot as necessary in response to the feet urging forward or backward motion.

If desired, the rotary couplings include at least four rollers that extend between the two frame elements, with at least two rollers underlying the platform that are arranged closer to each other than the remaining two of the at least four are to each other. Preferably, three rollers underlie the platform.

Each roller preferably has a groove that encircles the respective roller. The wheel has a peripheral track, which projects along an inner periphery of the wheel and fits into the grooves so that the track guides along the grooves of the rollers as the rollers rotate in unison with rotation of the wheel. The track effectively keeps dust and rainwater from collecting into the inner periphery of the wheel that might otherwise adversely affect the rolling contact between the rollers and the track.

BRIEF DESCRIPTION OF THE DRAWING

For a better understanding of the present invention, reference is made to the following description and accompanying drawings, while the scope of the invention is set forth in the appended claims.

DETAILED DESCRIPTION OF THE PREFERRED EMBODIMENT

A user wears a conventional helmet, elbow guards, knee guards and hand guards as a safety precaution. Initially two wheel skate devices in accordance with the invention are positioned on pavement close to each other side-by-side and angled with the forward end of the foot placement platforms touching the pavement.

Figure 1:
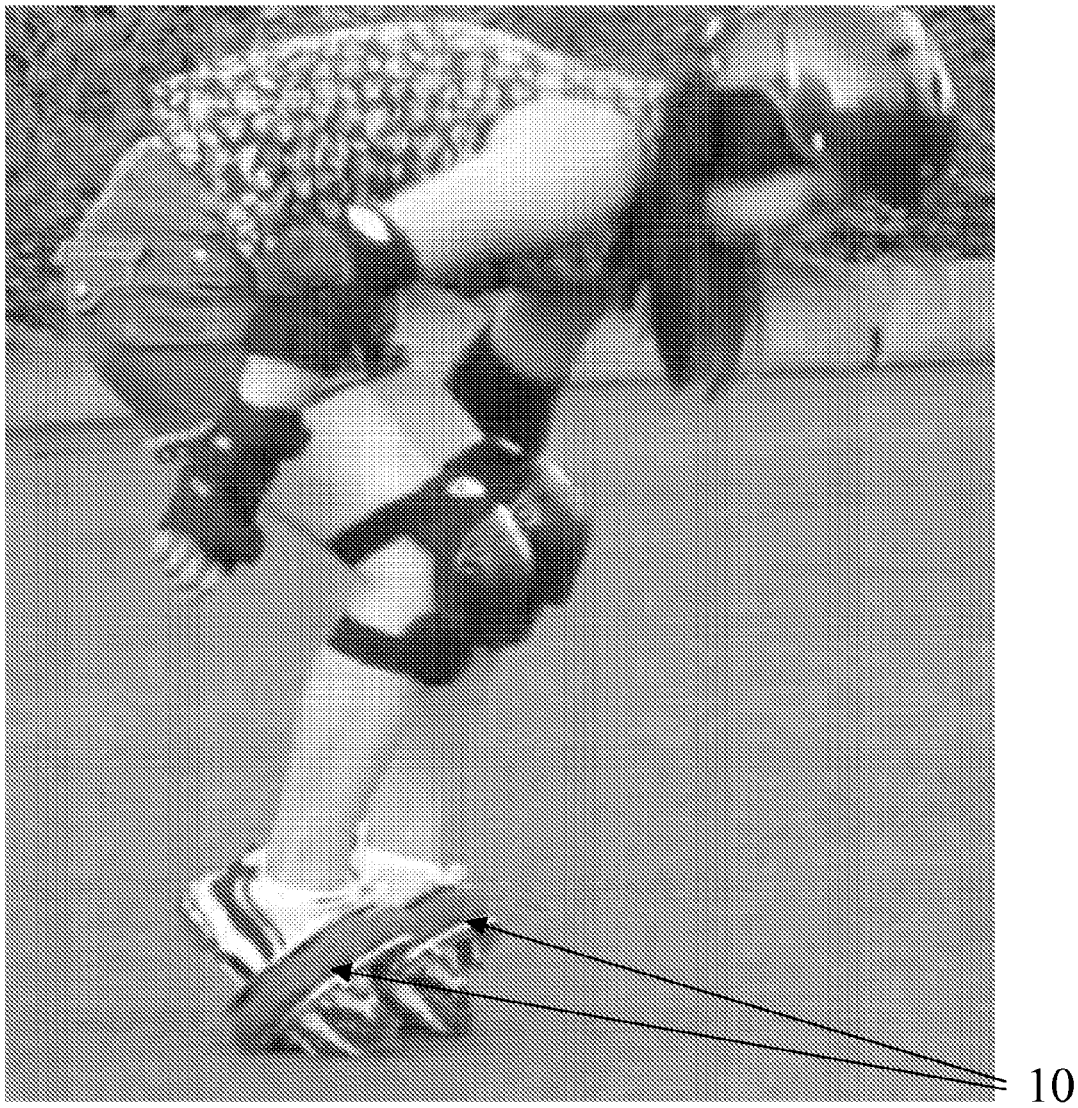
FIGS. 1-5 are photographs showing in sequence the starting procedure for using the skate devices of the present invention.
Figure 2:
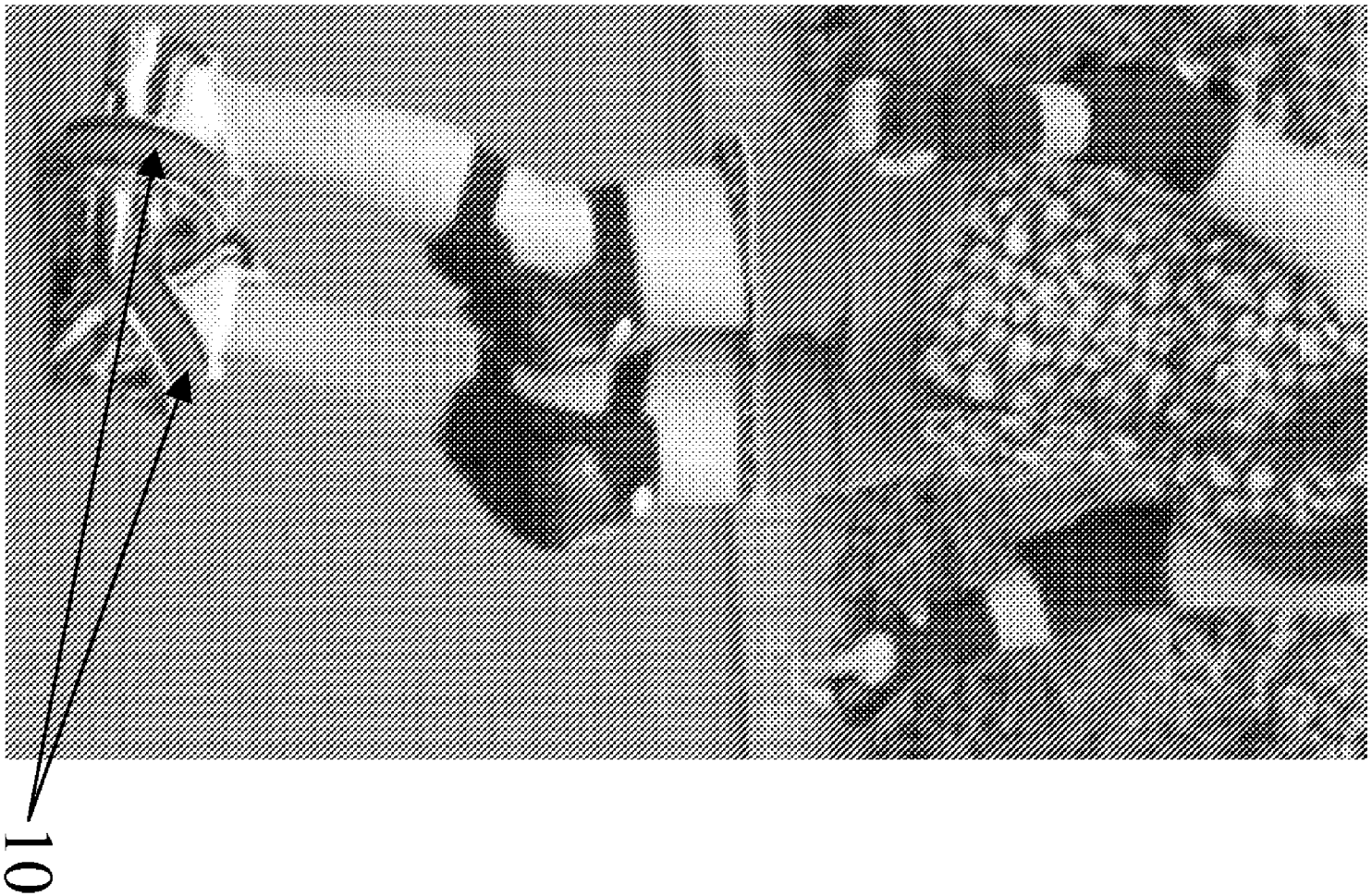

Turning to starting procedure reflected in sequence of photographs in FIGS. 1-5, the user inserts the toe portions of his/her feet through the respective skate wheel devices 10 and places the bottom of the feet onto the associated foot placement platform in the manner of FIG. 1. The feet are now angled either with the toes or heel touching the ground, depending upon one's preference. If the toes touch the ground, then the toes are lowered down while the heel is raised up. Otherwise, the heel is lowered down while the toes are raised up.

While keeping one foot stationary, the other foot is then moved sideways by rolling the wheel skate of such other foot to the side by pushing off with the stationary foot. The user's weight shifts accordingly. At the same time that the other foot is moved sideways, this other foot is lifted so that the portion of the foot that was touching the ground, whether it be the toes or the heel, no longer does so—both the toes and heel are off the ground in the manner of FIG. 2.

Figure 3:
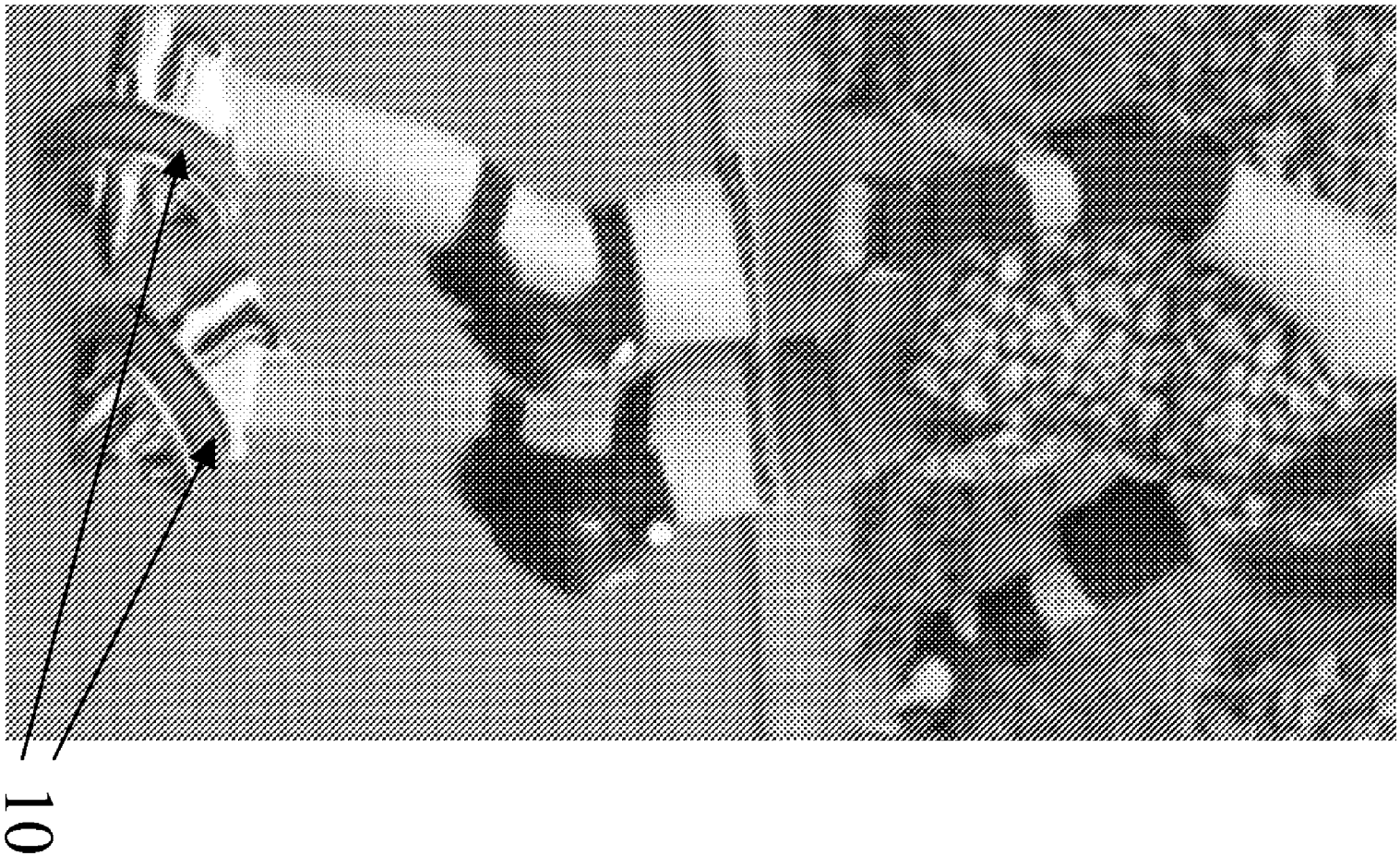
Figure 4:
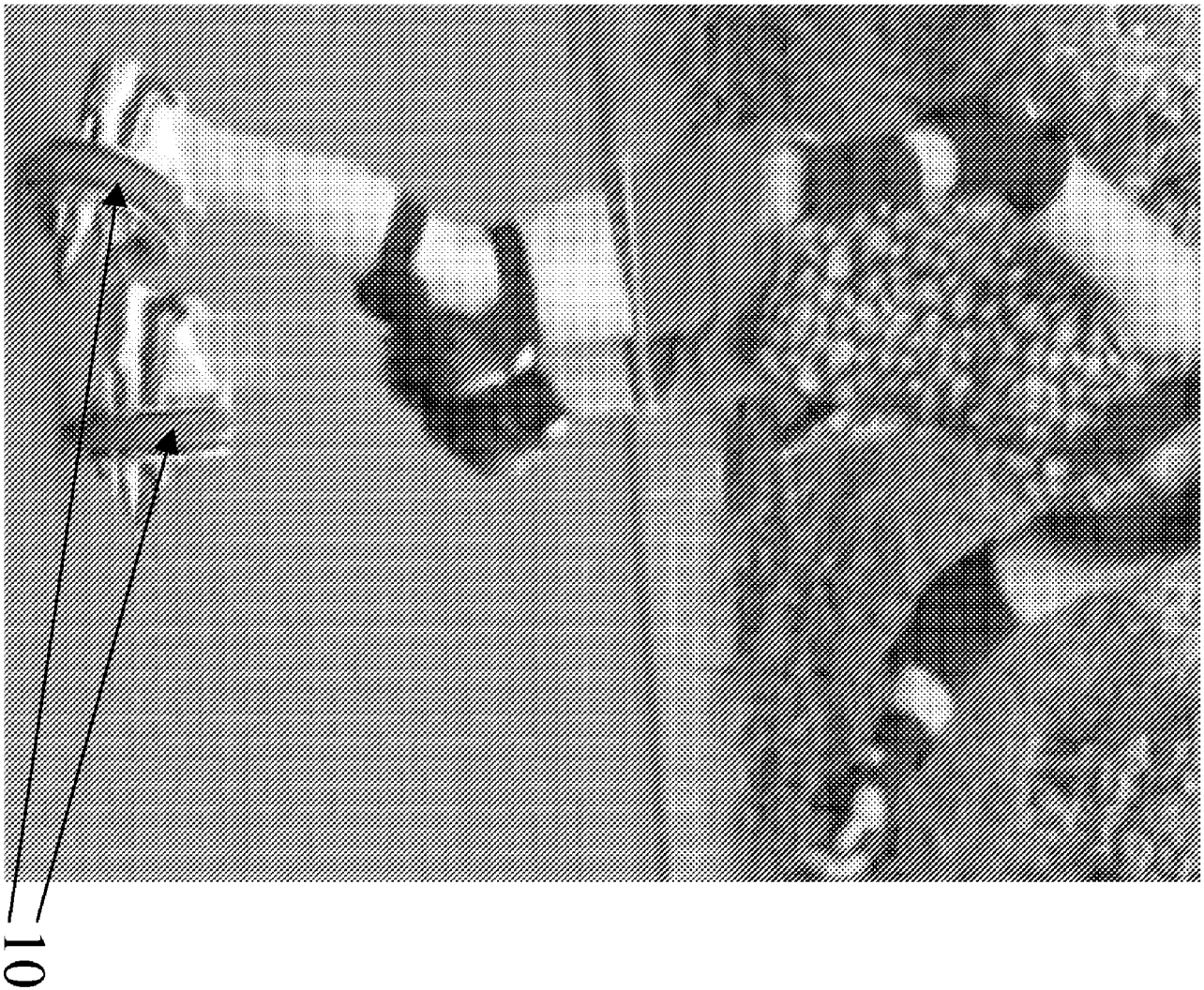
Figure 5:
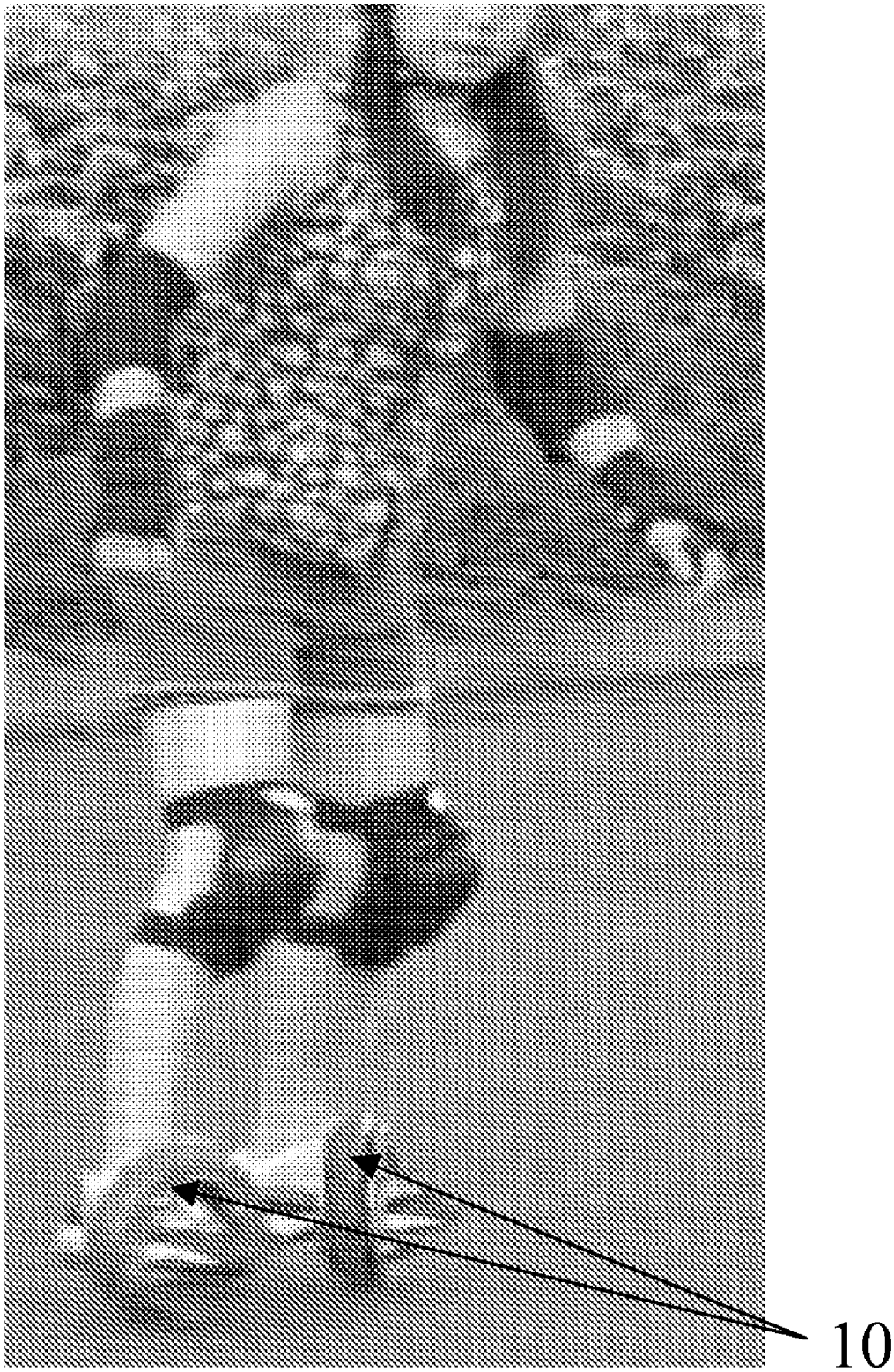

Eventually, the user's legs spread apart in the manner of FIG. 3. While maintaining the momentum from spreading the legs apart, the portion of the stationary foot that was touching the ground is likewise raised so that neither the heel nor toes are touching the ground. In doing so, the weight of the user shifts more toward the one foot to free the other foot to be righted in the manner of FIG. 4. When both feet are generally horizontal, the user continues the side rolling movement in the same direction with both feet to gain momentum with the two skate wheel devices 10 and may twist their feet independently in the manner of FIG. 5. By doing so, the user may perform turns by allowing the skate wheels to angle away from each other.

In use, a user places both feet on respective foot placement platforms while two skates are on the ground such as a paved roadway. The user moves sideways by alternating the feet in a forward and backward motion separately, and twisting both feet inward and outward upon initiating the forward and backward motion. However, if the foot placement platform can pivot about a pivot mechanism, then the foot placement platform functions in a manner analogous to a caster to pivot automatically as the user urges the feet forward or backward as desired. The wheels pivot relative to the frame automatically in response to the user urging their feet forwards or backwards.

Figure 6:
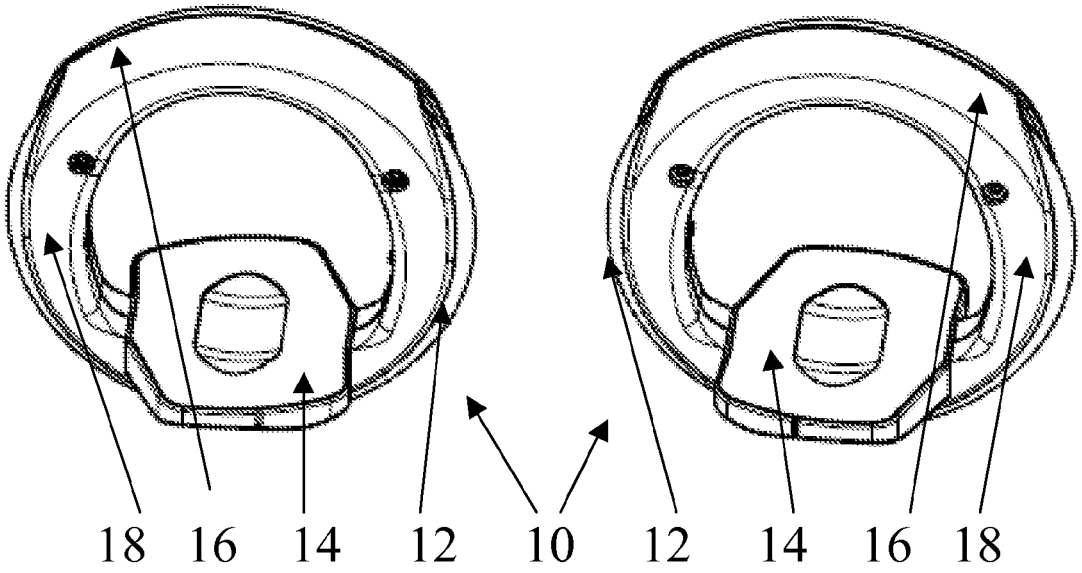
FIG. 6 is an isometric view of a pair of wheel skate devices in operative position in accordance with the invention.

Turning to FIG. 6, the two wheel skate devices 10 in accordance with the invention are shown. Each includes a wheel 12 that rotates between two spaced apart plates of a frame and about a wheel axis. A foot placement platform 14 is coupled to the frame 18. A wheel guard 16 is secured to the frame 18 to extend along its sides and bend over the wheel 12. Thus, the wheel guard 16 helps protect the user from injury that might otherwise result from the user coming into contact with the rotating components of the wheel skates 10. The foot placement platforms 14 are positioned at an elevation beneath the center of the associated skate wheels, as low as practical and yet provide ample room to accommodate placement of the foot upon its upper facing surface.

Figure 7:
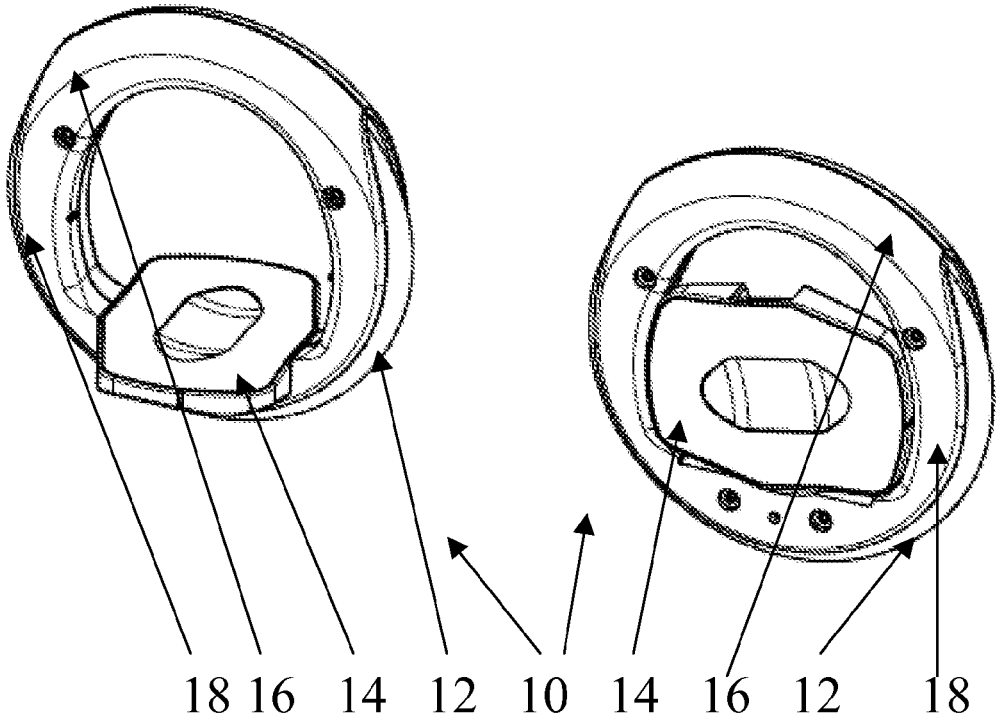
FIG. 7 is an isometric view of the pair of wheel skate devices of FIG. 6 but with one of the foot placement platforms in a stowed position.

Turning to FIG. 7, a similar view to that of FIG. 6 is shown, except that one of the skate wheel devices 10 has its foot placement platform 14 detached from its operative position and placed into a stowed position. It is dimensioned and its ends are shaped to generally conform to the shape of the inner facing surface of the frame 18 to which it is to be stowed. Indeed, the stowed foot placement platform 14 fits within confines of an elongated space that is defined by the contour of the inner facing edge of the frame 18 through the skate wheel device 10.

Figure 8:
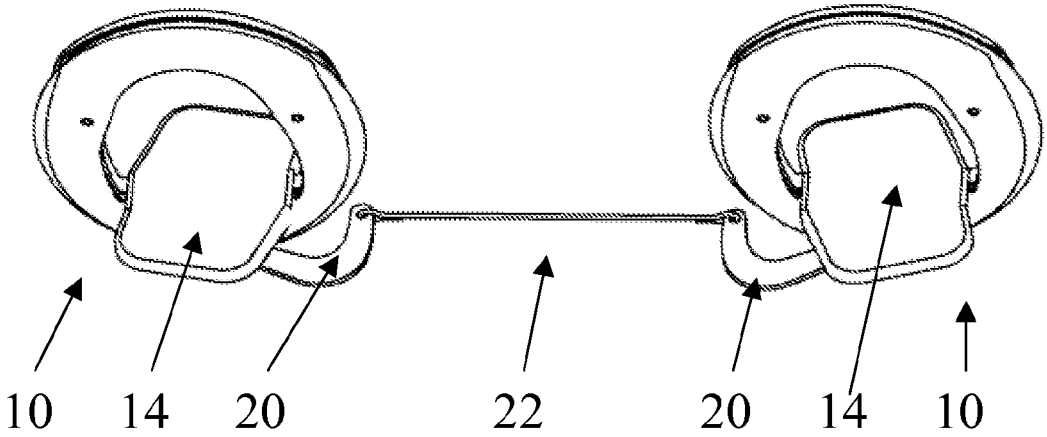
FIG. 8 is a top isometric view of the pair of skate devices of FIG. 6 but with a link extending between the two skates.
Figure 9:
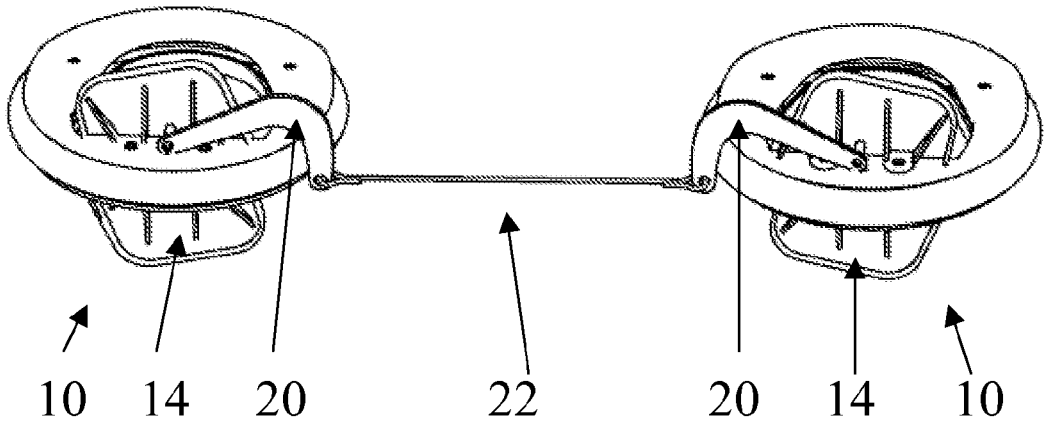
FIG. 9 is a bottom isometric view of FIG. 8.

Turning to FIGS. 8 and 9, the two skate wheel devices 10 are joined together by respective connectors 20 that join a common link 22. The link may be made of an elastic material to be stretchable. Otherwise, the common link 22 may be made of an inelastic material and thus not be stretchable, but preferably the link is still flexible. Such a common link 22 is helpful to a beginner using the two skate devices 10 since the link adds a force against spreading the legs far apart. The connectors 20 are preferably at locations lower than the foot placement platforms 14.

Figure 10:
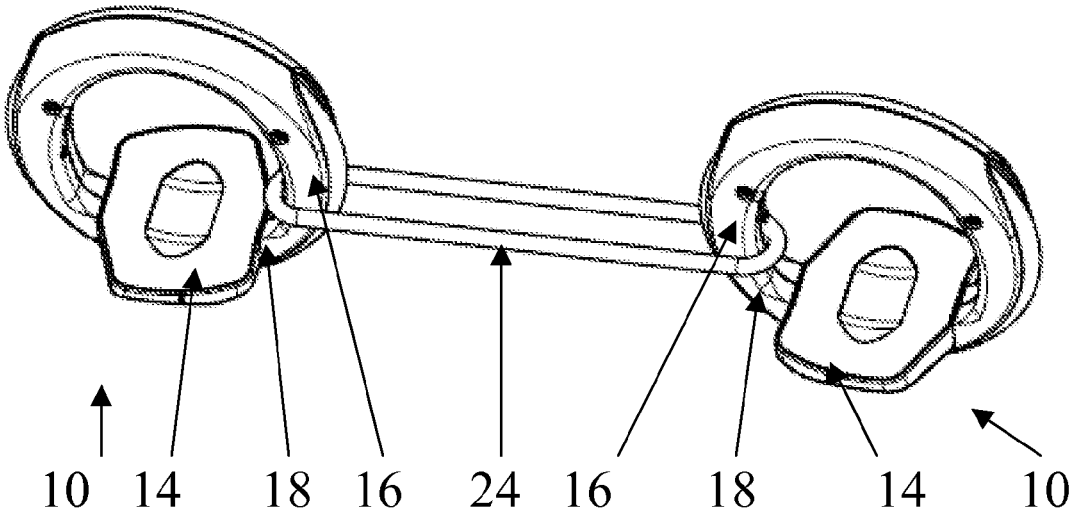
FIG. 10 is an isometric view of a different embodiment to that of FIGS. 8 and 9.

Turning to FIG. 10, an alternative looped link 24 is used instead that dispenses with the need for the connectors 20 and link 22 of FIGS. 8 and 9. Instead, the looped link 24 wraps around the frame 18 of each skate wheel device 10 and over the side of the wheel guard to span the shortest distance between the two skate wheel devices 10 when in operation. The looped link 24 may be made of elastic or inelastic material. It has two elongated portions and two curved end portions.

The looped link 24 may be opened to allow the wheel skates o be removed from being connected together via the looped link 24. For instance, a locking mechanism may be provided at the location where the curved end portions join the two elongated portions. Such a locking mechanism may be internal screw threads that enable the user to unscrew or screw one of the two elongated portions to the two curved end portions as desired portions and moving the two skate wheels through the gap formed where the elongated portion used to be attached.

Figure 11:
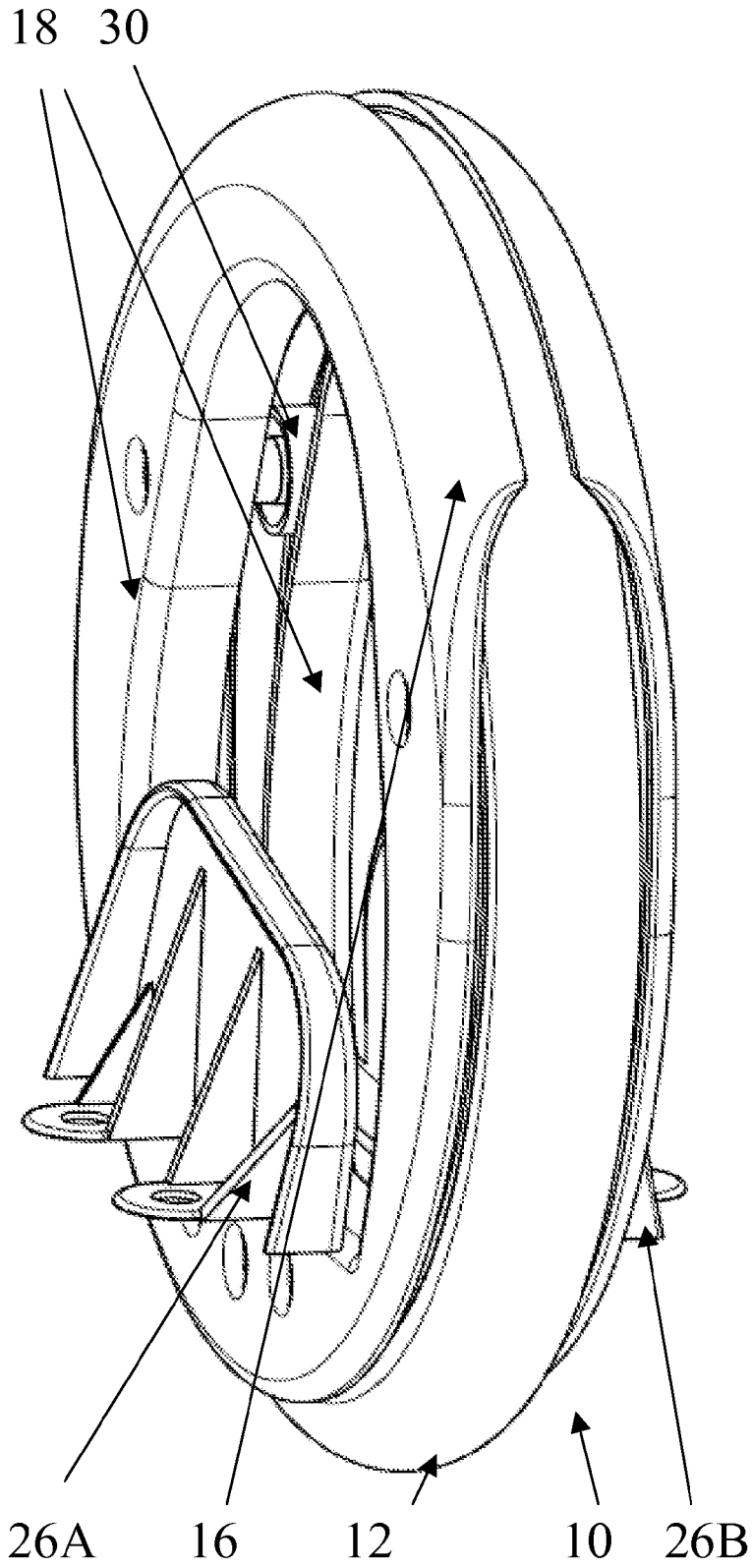
FIG. 11 is an isometric view of a further embodiment to that of FIG. 7 with the foot placement platform in a stowed position.

FIG. 11 shows an alternative embodiment for the foot placement platform, which has an outward extension 26A pivoted into a closed position. There is another outward extension 26B on the opposite side of the skate wheel device 10 that is symmetric to that of the outward extension 26A. Both the wheel 12 and the wheel guard 16 are shown. The wheel guard 16 constitutes two halves that are symmetric with each other. While they cover the top half of the wheel 12, they may leave a circumferential gap along the topside as shown.

Figure 12:
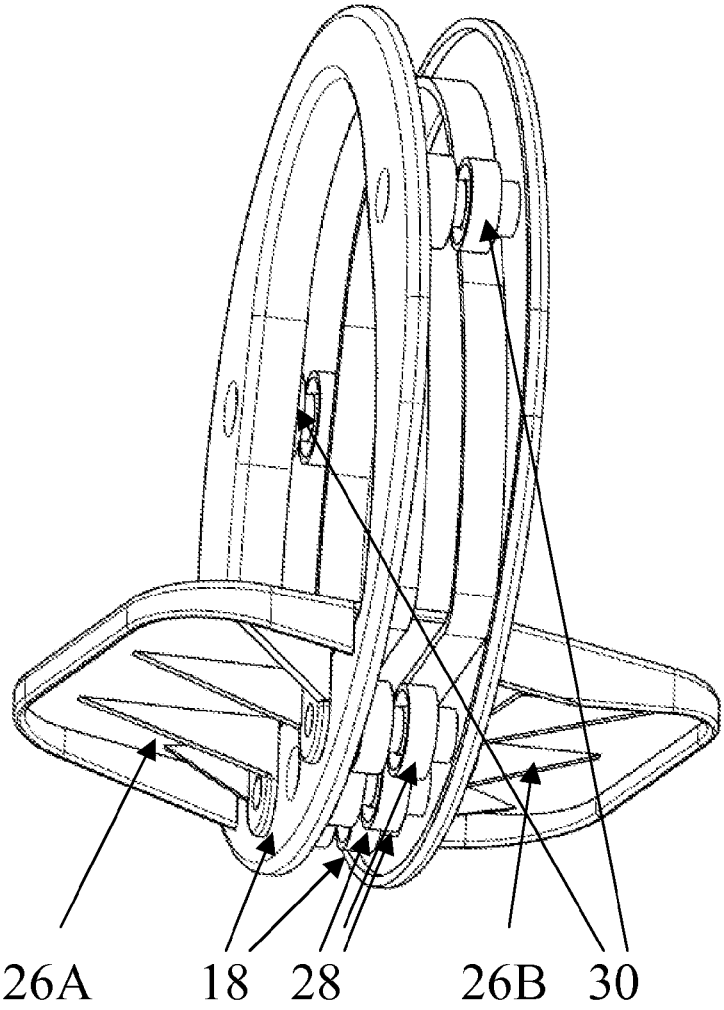
FIG. 12 is an isometric view of the further embodiment of FIG. 11, but with the foot placement platform in an extended, operative position. The wheel guard and wheel removed.
Figure 13:
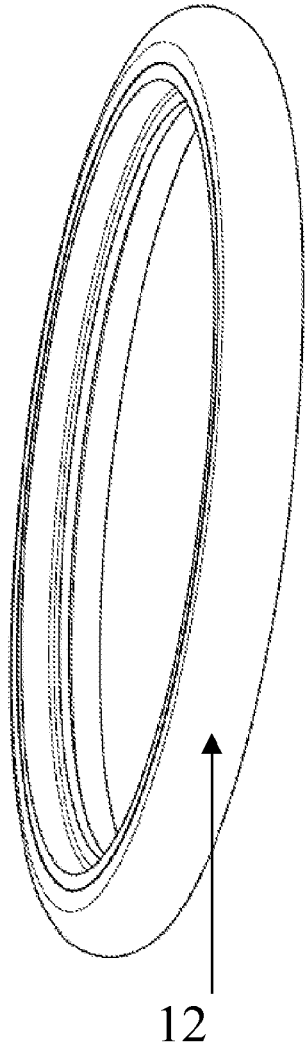
FIG. 13 is an isometric view of the wheel to be fitted onto rotary couplings of the further embodiment of FIG. 12.

FIG. 12 shows the outward extensions 26A, 26B of FIG. 11 in their operative, extended positions to serve as a foot placement platform. FIG. 13 shows the wheel 12 to be fitted onto the rotary couplings in the form of grooved rollers 30 that are to the outside of the frame 18.

Figure 14:
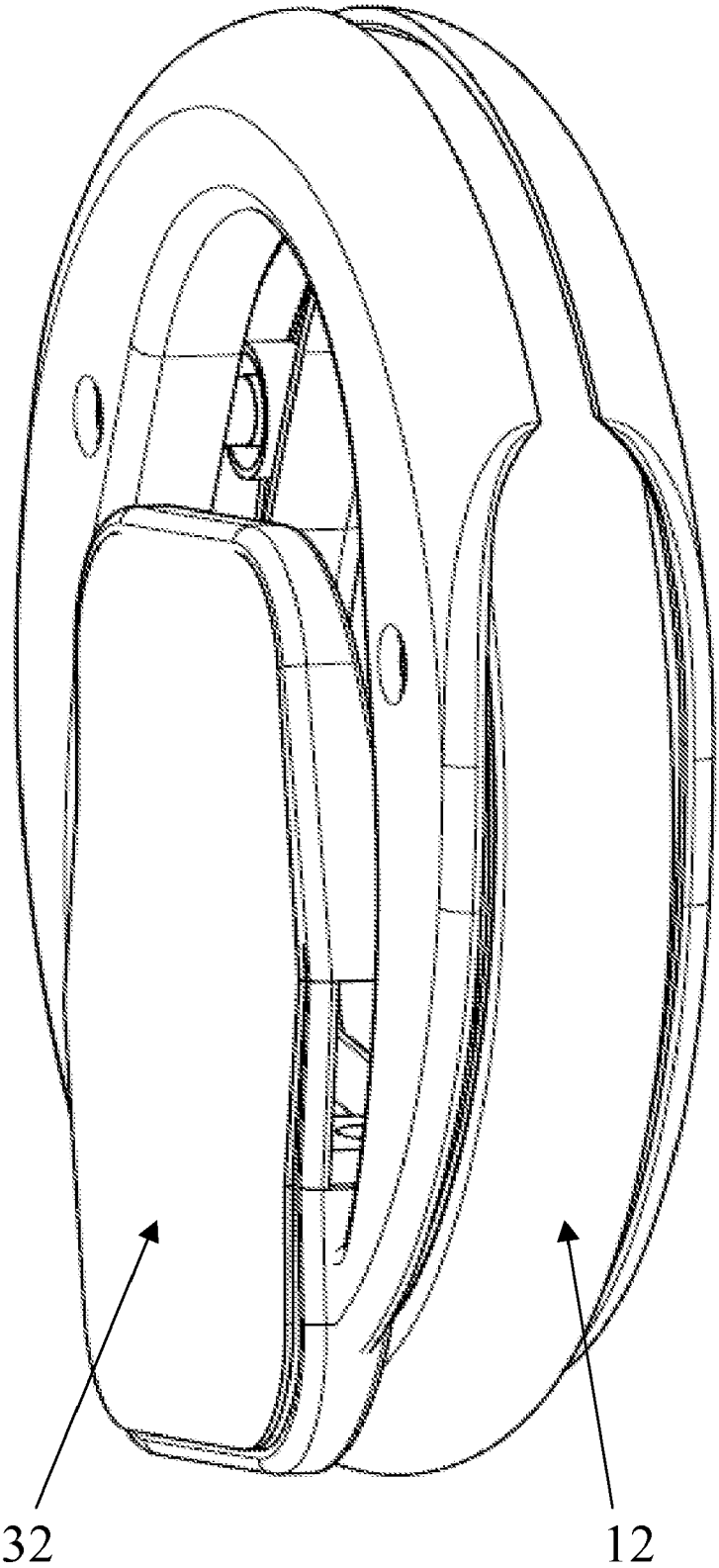
FIG. 14 is an isometric view of a further embodiment showing the foot placement platform in a stowed position.

FIG. 14 shows another embodiment that is the same as that of the embodiment of FIGS. 11-13, except that the foot placement platform 32 pivots in its entirety into a stowed position, as opposed to pivoting by halves as in FIG. 12.

Figure 15:
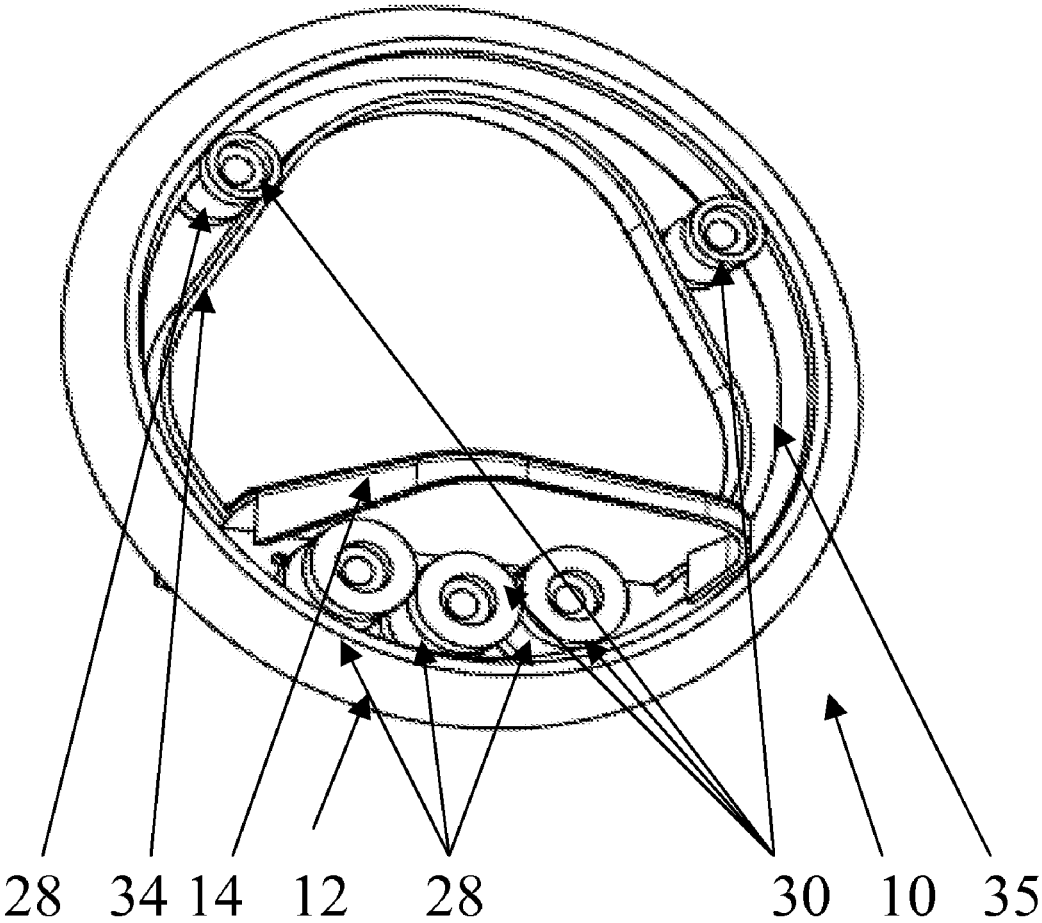
FIG. 15 is a top isometric view of an additional embodiment.
Figure 16:
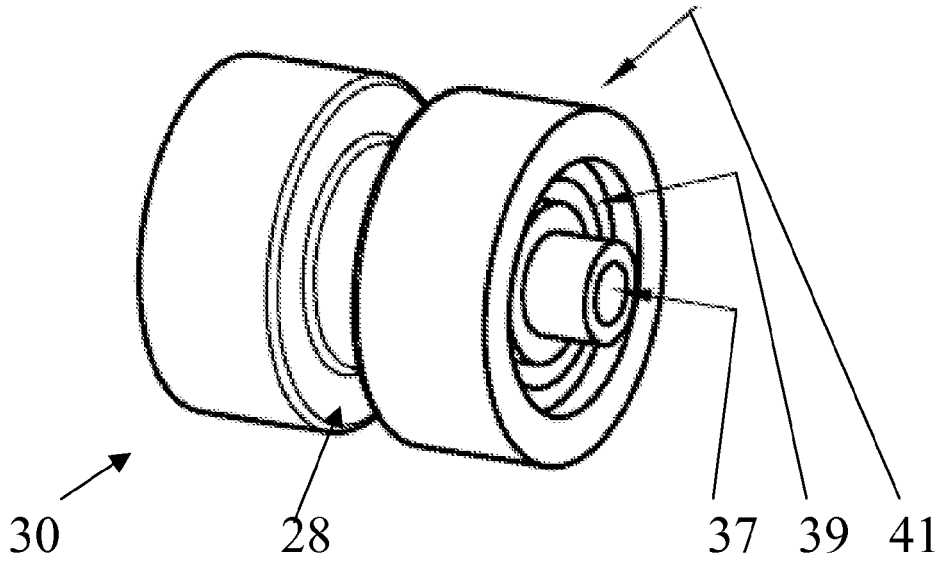
FIG. 16 is a front isometric view of a roller in FIG. 15.
Figure 17:
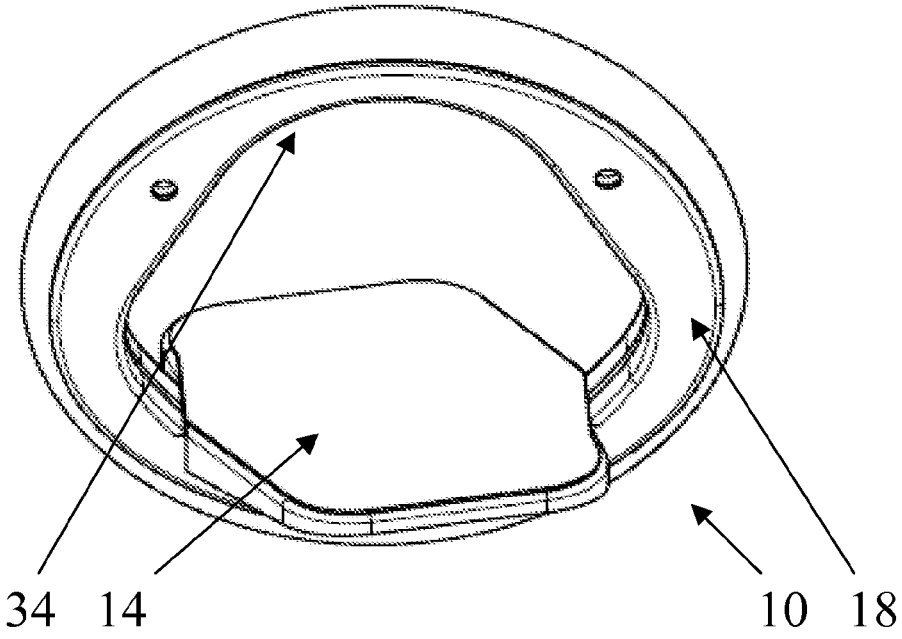
FIG. 17 is a bottom isometric view of FIG. 15.

FIGS. 15-17 shows an embodiment of the wheel skate device 10 that is the same the embodiments of FIGS. 11-14, except that the foot placement platform 14 is not pivotally connected in the manner of FIGS. 11-14, but rather detachable as in FIG. 7. The rotary couplings may include at least four or five rollers 30 each with a respective groove 28 that encircles. Preferably, there are at least two rollers 30 under the foot placement platform 32 that are closer to each other than remaining ones of the four or five rollers 30 are to each other.

The wheel 12 has a track 35 that extends in a circumferential manner about an inner periphery of the wheel 12. The track 35 and grooves 28 are dimensioned to allow the track 35 to fit within the grooves 28 in a manner that permits the rollers 30 to rotate about their respective roller axes and relative to the track 35 during wheel movement.

An advantage of such a construction is that dust and rainwater does not collect on the track 35 of the wheel 12 since the track lacks any inner peripheral groove into which such dust and rainwater could collect to lodge between the track and grooves. Although the rollers 30 have grooves 28, they are on the roller's outer periphery where they tend not to collect any appreciable amounts of dust and rainwater.

If the inner periphery of the wheel 12 had the groove and the rollers each had a projecting track that fit into the groove (as opposed to the other way around as in the preferred embodiment), the groove of the wheel would be susceptible to collecting dust and rainwater. Such could adversely affect rolling performance, because the dust and rainwater could lodge between the groove and the track in such a case.

Turning to FIG. 16, the roller 30 is shown in greater detail. The roller 30 includes a cylindrical shaft 37 that extends through the length of the roller and projects outwardly to be held by a corresponding support of the frame at both ends of the roller 30. There are two roller surfaces 41 spaced from each other by the groove 28. A bearing 39 resides between the cylindrical shaft 37 and the roller surfaces 41/groove 28. By inserting the track 35 of FIG. 15 into the groove 28, rolling contact is made between the track 35 and the roller 30 that enables the wheel 12 and the roller 30 to rotate in unison with each other. That is, the roller surfaces 41 rotate about the shaft 37 as the wheel 12 rotates about the wheel axis.

For clarity, the frame 18 of FIG. 17 is omitted in FIG. 15 so that the rollers 30 are apparent that would otherwise be hidden between opposite plates or frame elements of the frame 18. Also visible is an inner strip 34 that is positioned radially inside of where the rollers 30 are located that are attached to the frame 18. The inner strip 34 may serve as a support to which the foot placement platform 14 is attached.

Figure 18:
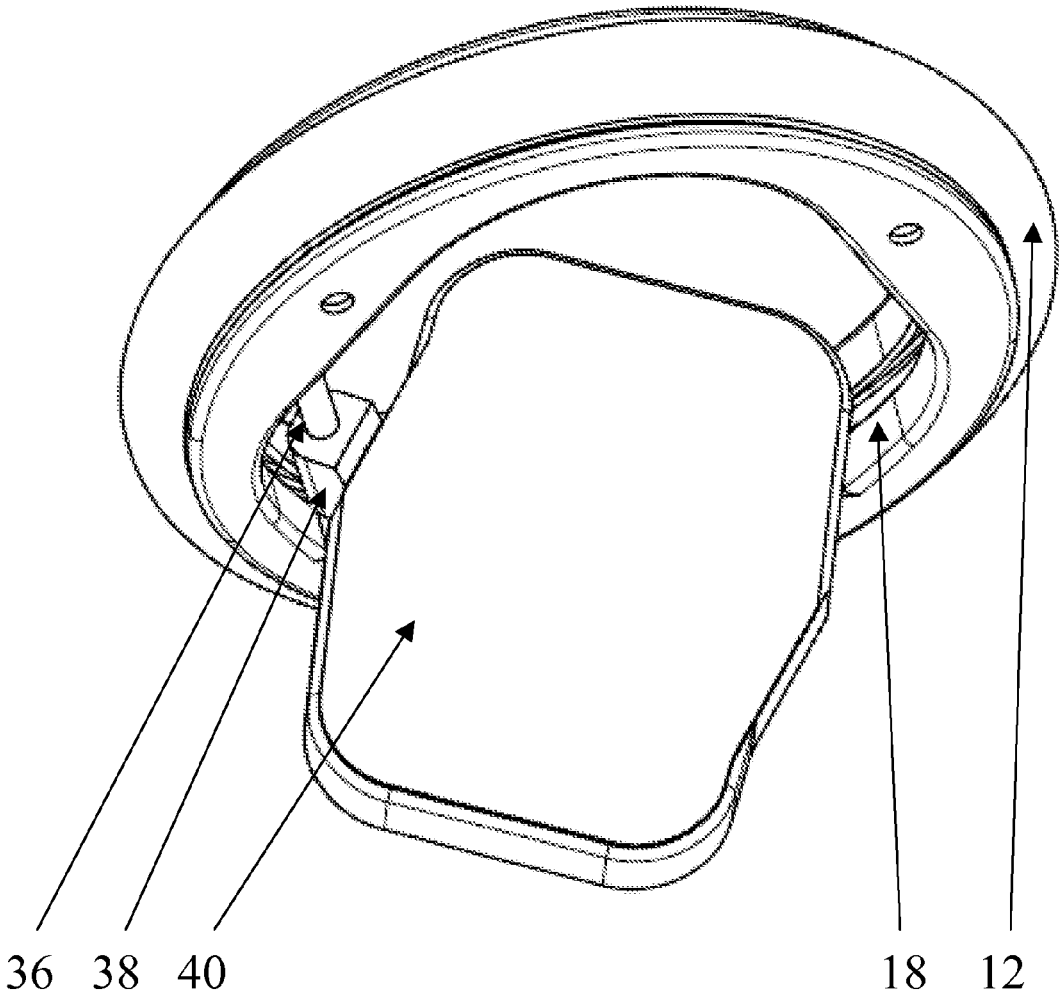
FIG. 18 is a top isometric view of a pivot mechanism embodiment.
Figure 19:
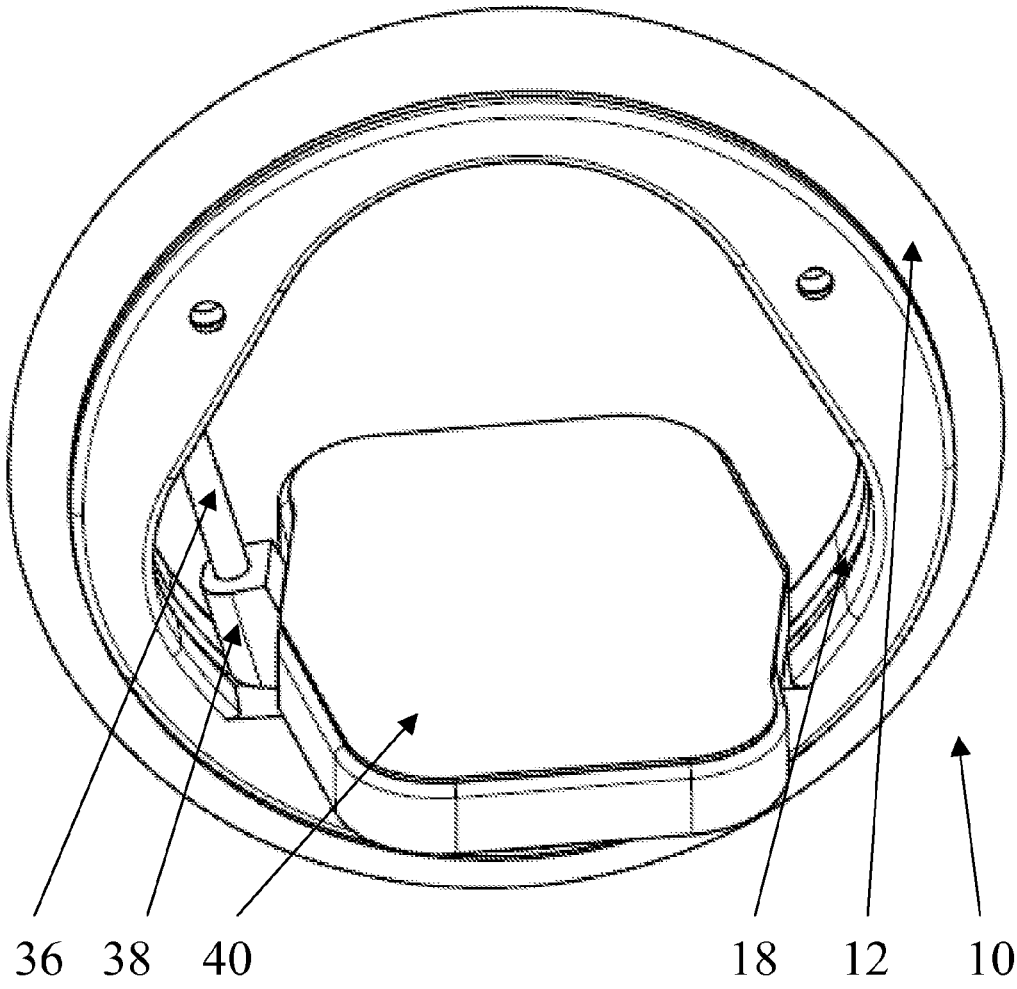
FIG. 19 is a front isometric view of FIG. 18.

FIGS. 18-19 show still another embodiment of the wheel skate device 10 that includes a pivot mechanism, namely, a shaft 36, a pivot 38 that has a hole and that is connected to a foot placement platform 40. The shaft 36 fits through the hole in the pivot 38 to allow the foot placement platform 40 to pivot about the shaft 36. The shaft 36 extends between two spaced apart locations of the frame 18 to pass through a portion of the interior space defined by the frame 18—one location being closer to an elevation of the axial center of the wheel 12 than the other. The location of the hole is offset from an areal center of the foot placement platform 4.

An advantage with the embodiment of FIGS. 18-19 is that effecting rolling movement is easier than without the pivot mechanism. For instance, the wheel skate travel sideways in FIGS. 1-5 by moving the feet separately forward and back as well as twist the feet to point the feet to converge and diverge with respect to each other as the feet separately move forward and back. Twisting or swiveling the feet to converge and diverge is difficult for beginners to master and takes much practice.

However, the pivot mechanism serves as a helpful guide to enable beginners to start rolling right away and concentrate on other aspects of their technique since the pivot mechanism assures that the feet will be exerting forces in the pivoting plane. That is, the pivot mechanism helps the wheels of the two wheel skates function as a caster that automatically pivots to allow the two wheel skates to separately move forward or backward as desired in response to urging by the feet in those directions.

Figure 20:
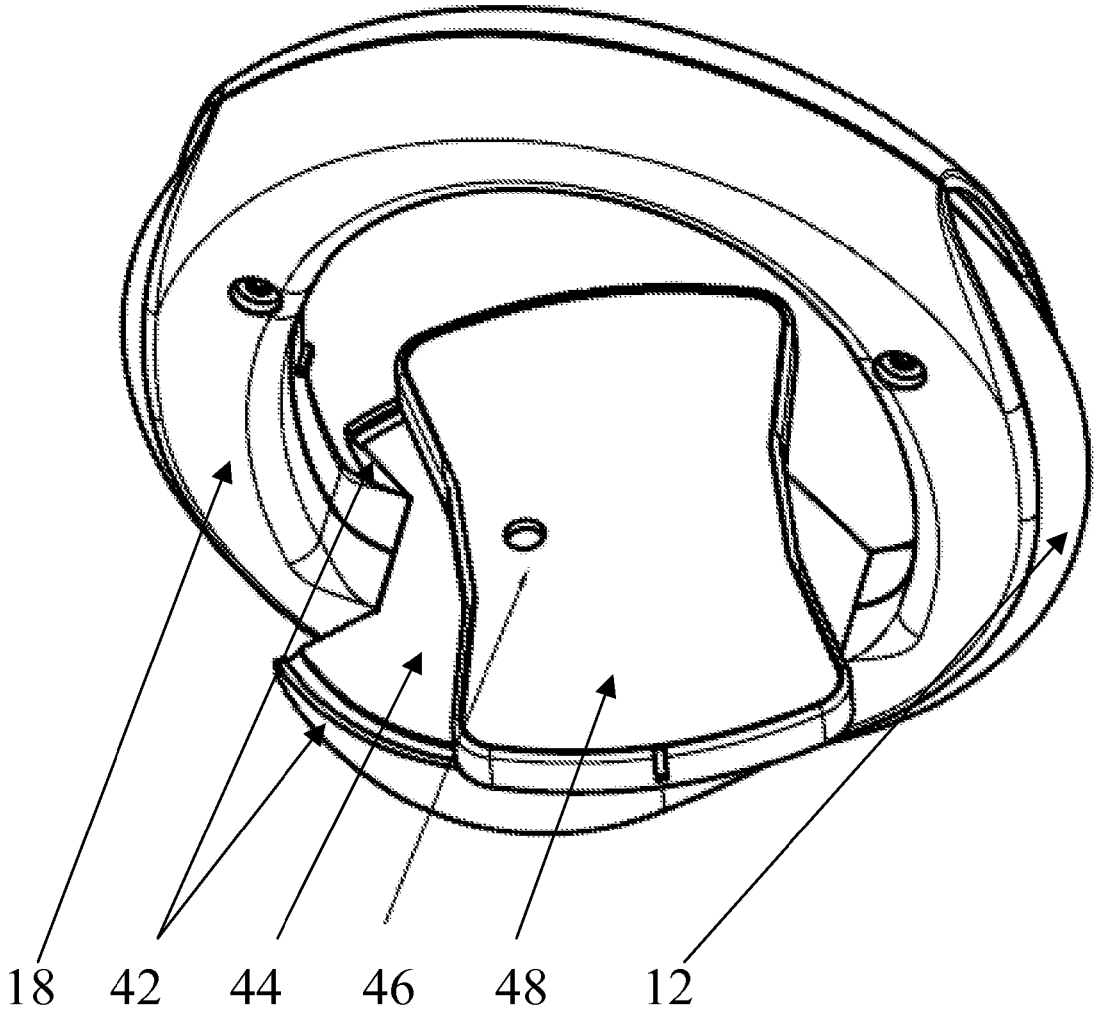
FIG. 20 is a top isometric view of a further pivot mechanism embodiment.

FIG. 20 is a variant of the embodiment of FIGS. 18-19. Instead of the pivot mechanism including the shaft 36 and pivot 38 of FIGS. 18-19, the pivot mechanism includes a grooved plate 42 whose top surface has opposite ends each with a respective convex groove 44. An off center axel 46 allows a foot placement platform 48 to pivot about the off center axel 46 to provide pivoting movement.

Figure 21:
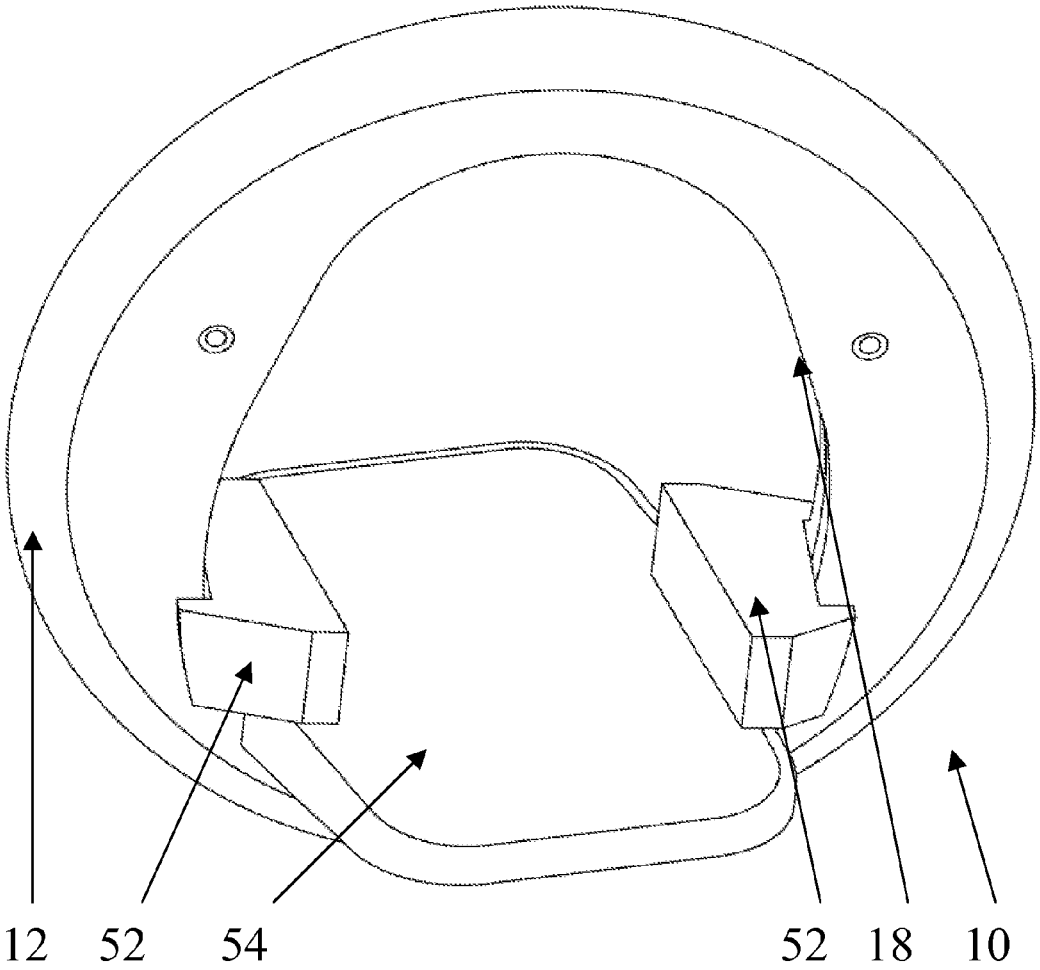
FIG. 21 is an isometric view of a foot guide embodiment.

FIG. 21 shows that the wheel skate device 10 can have guides 52 adjacent and on either side of the foot placement platform 54. The guides 52 rise above the surface where the user places a foot on the foot placement platform 54. The foot is guided between the guides 52, which provide additional contact surface area with the foot and thereby more stability to the user. The guides 52 may be clamped to the frame 18 as shown or otherwise fastened to it in a secured manner. Preferably, the guides are made of a resilient material that in effect squeezes the foot on both sides to help stabilize the foot to remain in a generally central location spaced from the frame on the foot placement platform.

Figure 22:
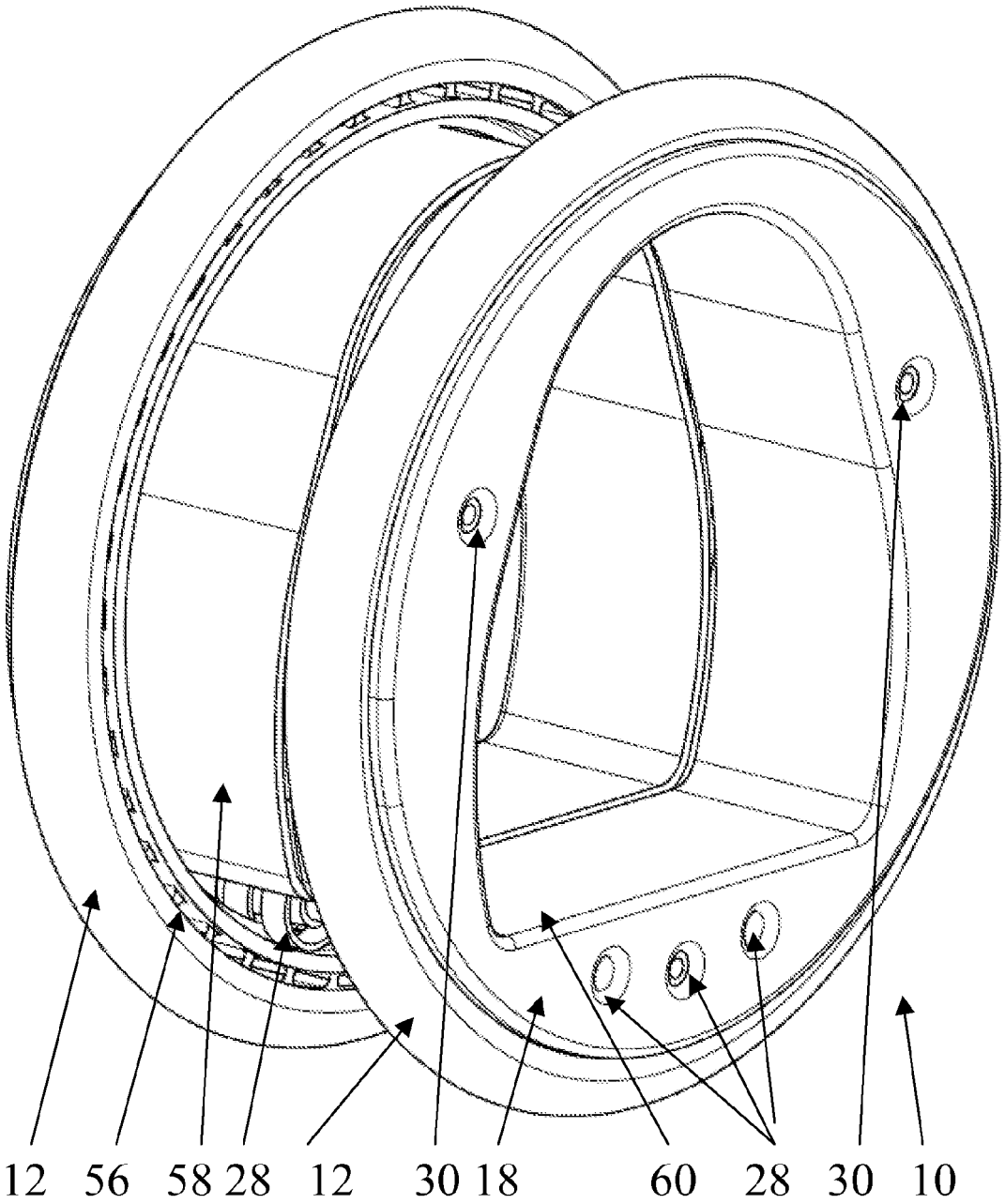
FIG. 22 is an isometric view of a double wheel embodiment.

FIG. 22 shows a two-wheeled embodiment of the skate wheel device 10 that has two wheels 12 spaced apart from each other in respective planes that are substantially parallel to each other. There are two pairs of frame elements 56 that are spaced apart and each pair provides a respective track path for the respective set of rollers 30 to rotate upon. The housing 58 includes frames 18 that are non-circular each with a flat bottom 60, which serves as a foot placement platform. The two wheels 12 may be equidistant from a central plane passing through a center of the wheel skate device that is between and parallel to the respective planes passing through the wheels.

Since each wheel 12 for the embodiment of FIG. 22 has its own associated set of rollers 30, it may spin or rotate about its respective wheel axis at a different speed than that of the other, which is advantageous during turning, because it is better for maintaining balance for the user if both wheels are not rotating at the same speed. This is because the inside wheel during a turn has a smaller distance to travel to complete the turn than that of the outer wheel. By providing each wheel with its own respective set of rollers, the wheel is afforded independence to rotate at different relative speeds.

Figure 23:
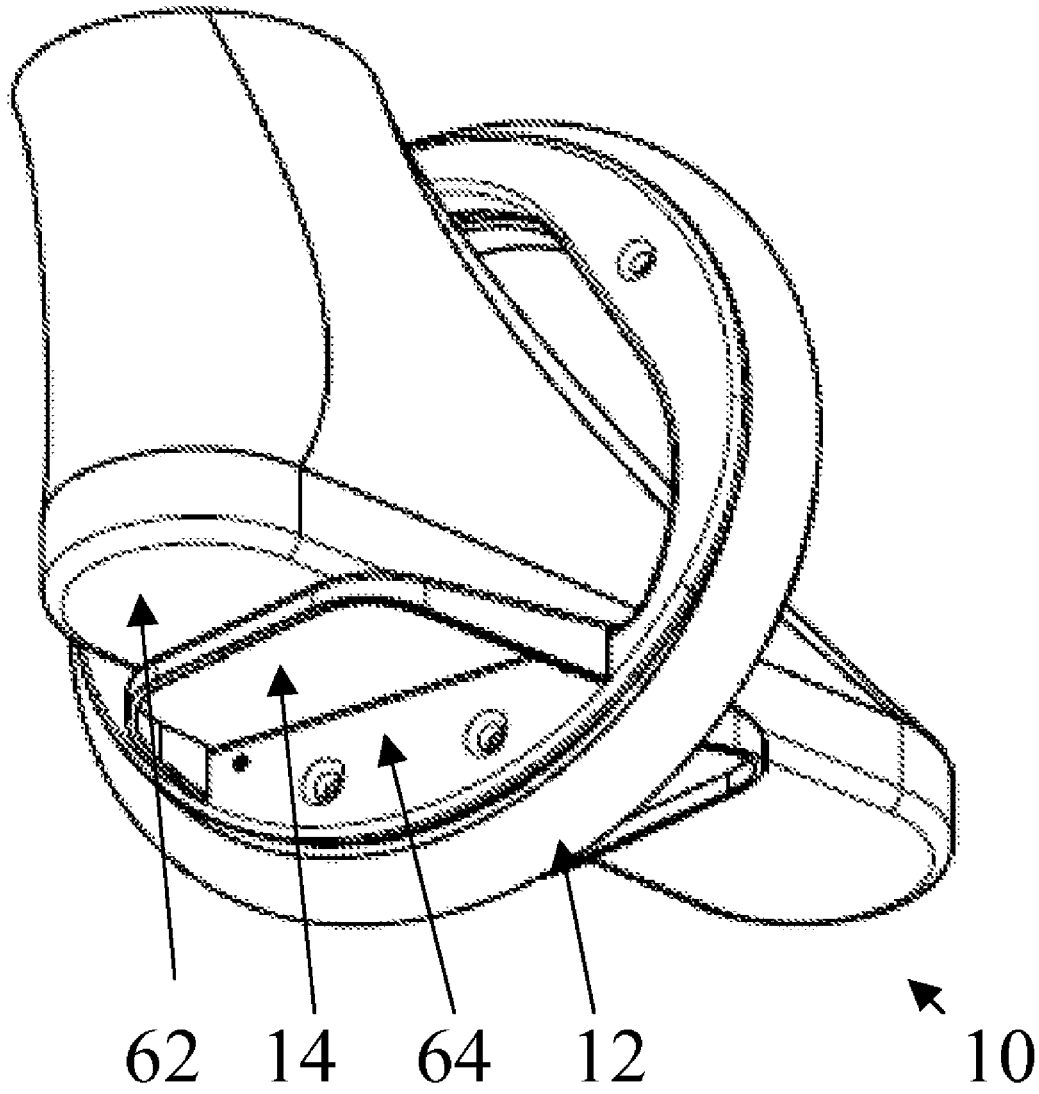
FIG. 23 is an isometric view of a boot embodiment.

FIG. 23 shows a boot embodiment of the wheel skate device 10 in which a boot 62 is secured to the foot placement platform 14 in any conventional manner, such as with mechanical fasteners or epoxy. Also shown is a housing plate 64 that contains the rollers 30. The top of the housing plate 64 may be used to secure the foot placement platform 14 to which in turn is secured the boot 62. As an alternative, the base of the boot 62 may constitute the foot placement platform by being secured to the frame in any conventional manner at about the same location where the foot placement platform would otherwise be located.

Figure 24:
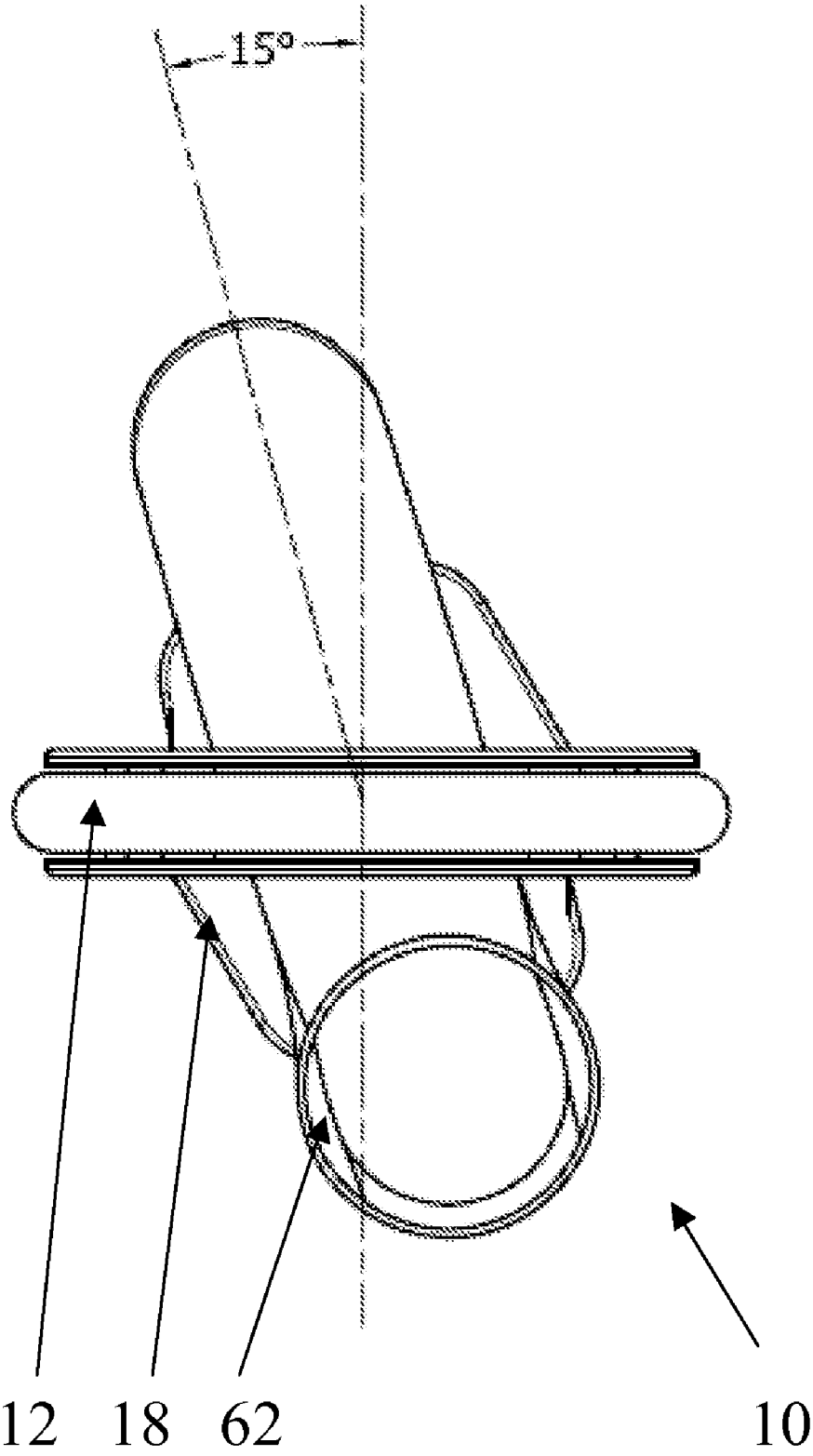
FIGS. 24 and 25 show schematic views of an angled embodiment for left and right skate wheel devices.
Figure 25:
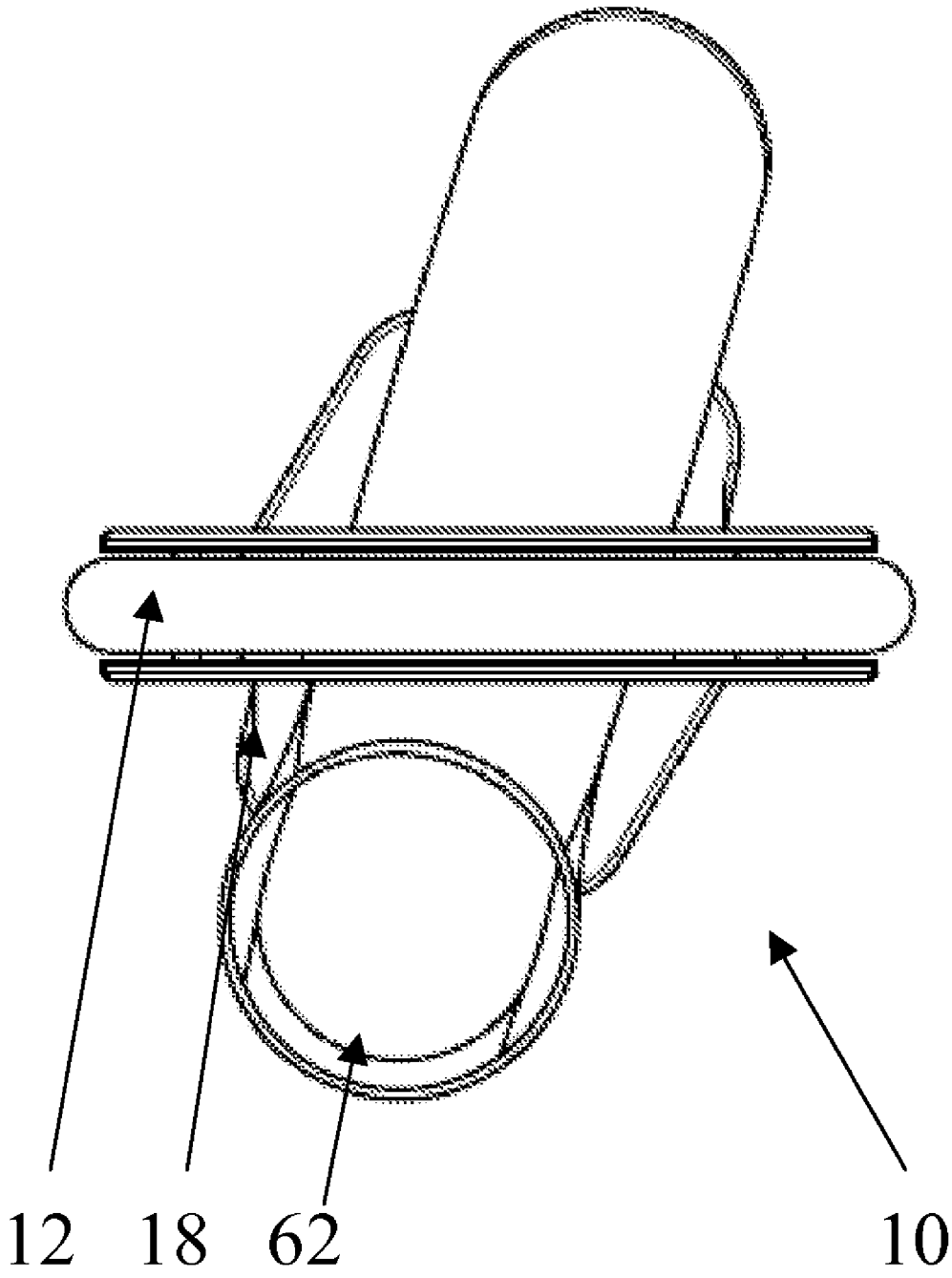

FIGS. 24 and 25 show the foot placement platform 14 mounted at an oblique angle within a horizontal plane, such as 5 to 35 degrees relative to the user's facing direction with respect to the relative position of the wheel 12. Such positioning helps the user point feet to diverge or converge as applicable during wheel skate movements.

Figure 26:
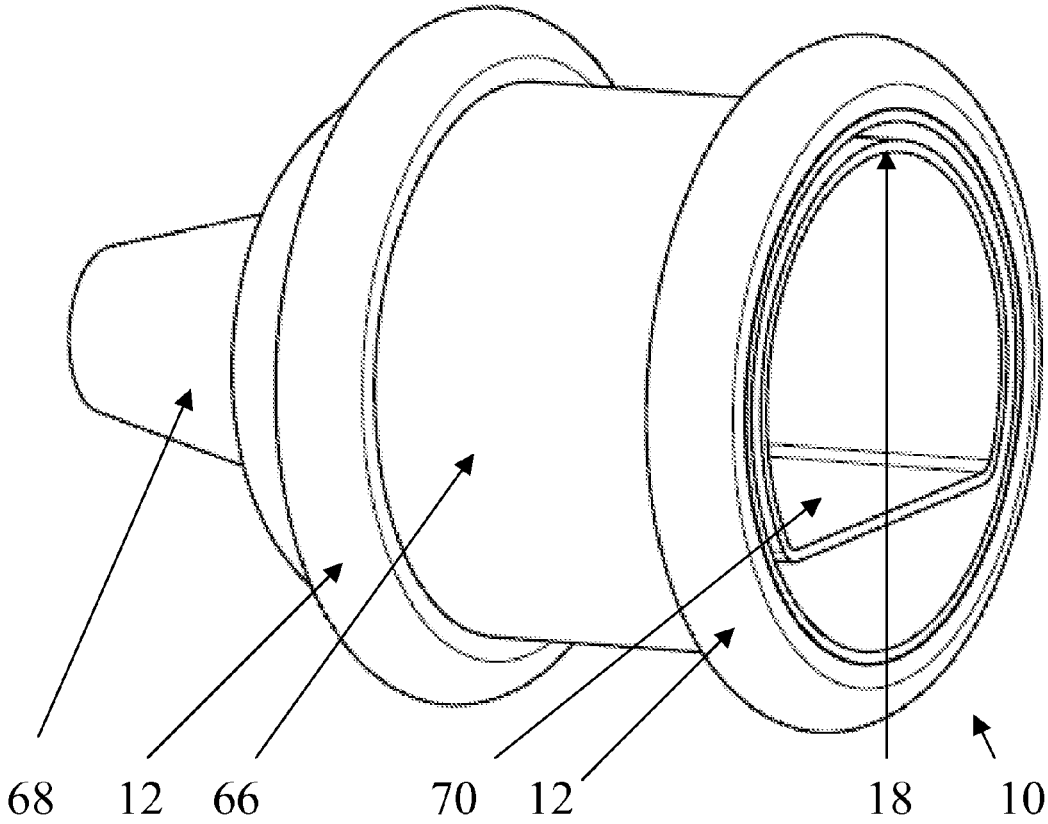
FIG. 26 is an isometric view of a wheel skate device in accordance with a tapering embodiment.
Figure 27:
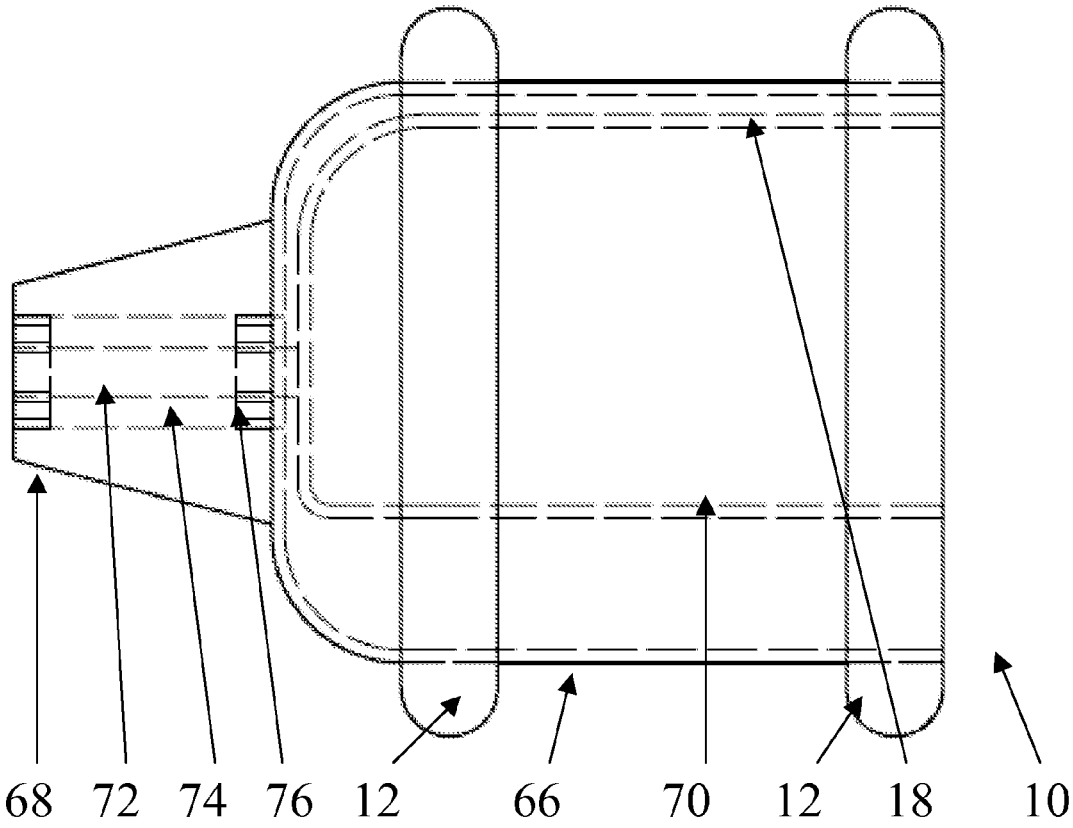
FIG. 27 is a schematic view of the embodiment of FIG. 26.

FIGS. 26 and 27 are a variation of the skate wheel device of FIG. 22. There are double wheels 12, although a single wheel could be used instead if situated between and equidistant of the two wheels. A housing 66 supports the wheels 12 to extend outwardly at one side in a taper 68. The frame 18 has a flat bottom 70 at one end that serves as a foot placement platform and terminates at the opposite end into a projecting shaft 72.

The taper 68 defines a passage into which projects the shaft 72. A space 74 is provided about the shaft 72 to accommodate a single bearing 76 or roller. Thus, the bearing 76 is between the shaft 72 and the taper 68 and allows the taper 68 to rotate relative to the shaft 72. The rotation of the taper 68 arises from rotation of the wheels 12, which turn the housing 66 in unison. The user places a foot onto the flat bottom 70 to operate the skate wheel device on pavement. The single bearing 76 is responsible for allowing the wheels 12 to rotate relative to the frame 18.

Figure 28:
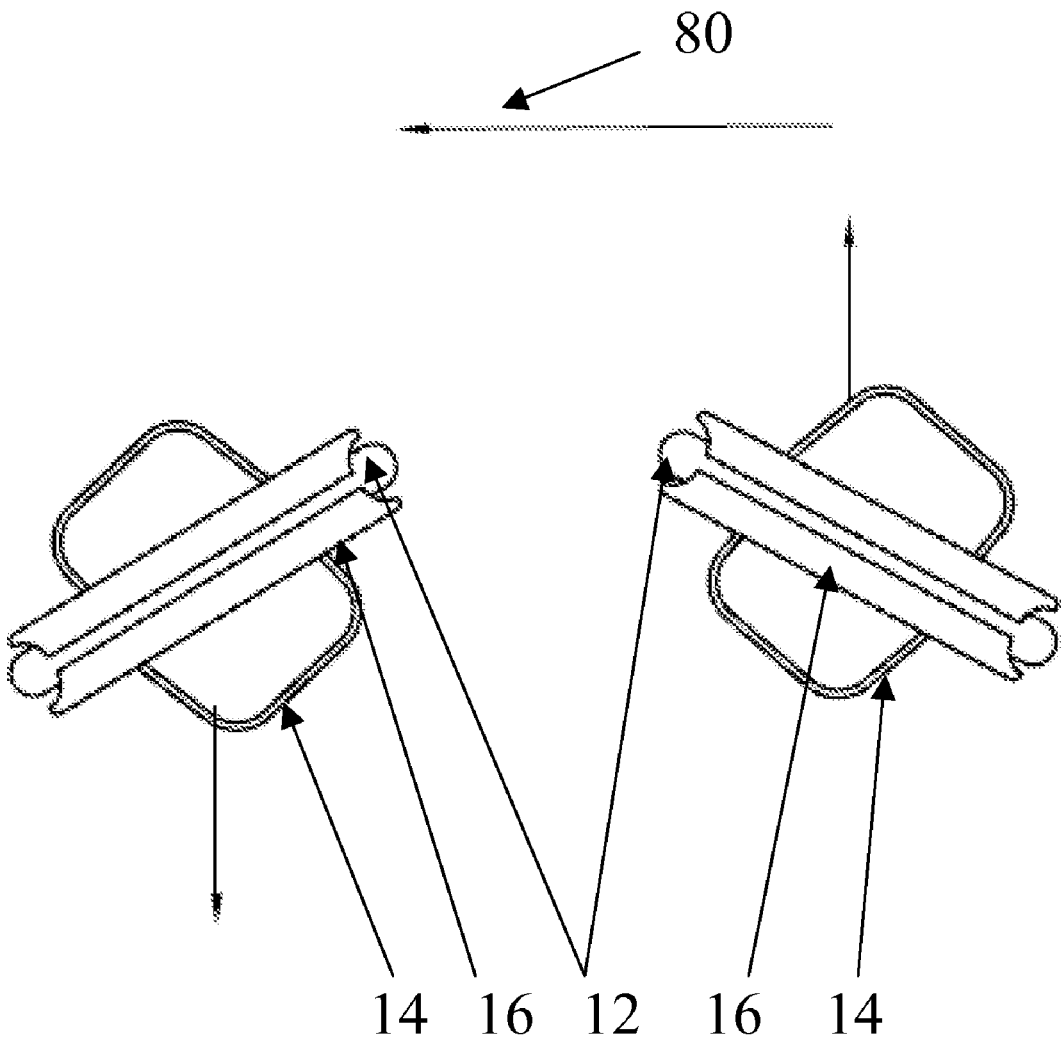
FIGS. 28 and 29 are vector diagrams showing directional vectors for two wheel skate devices in accordance with the invention.
Figure 29:
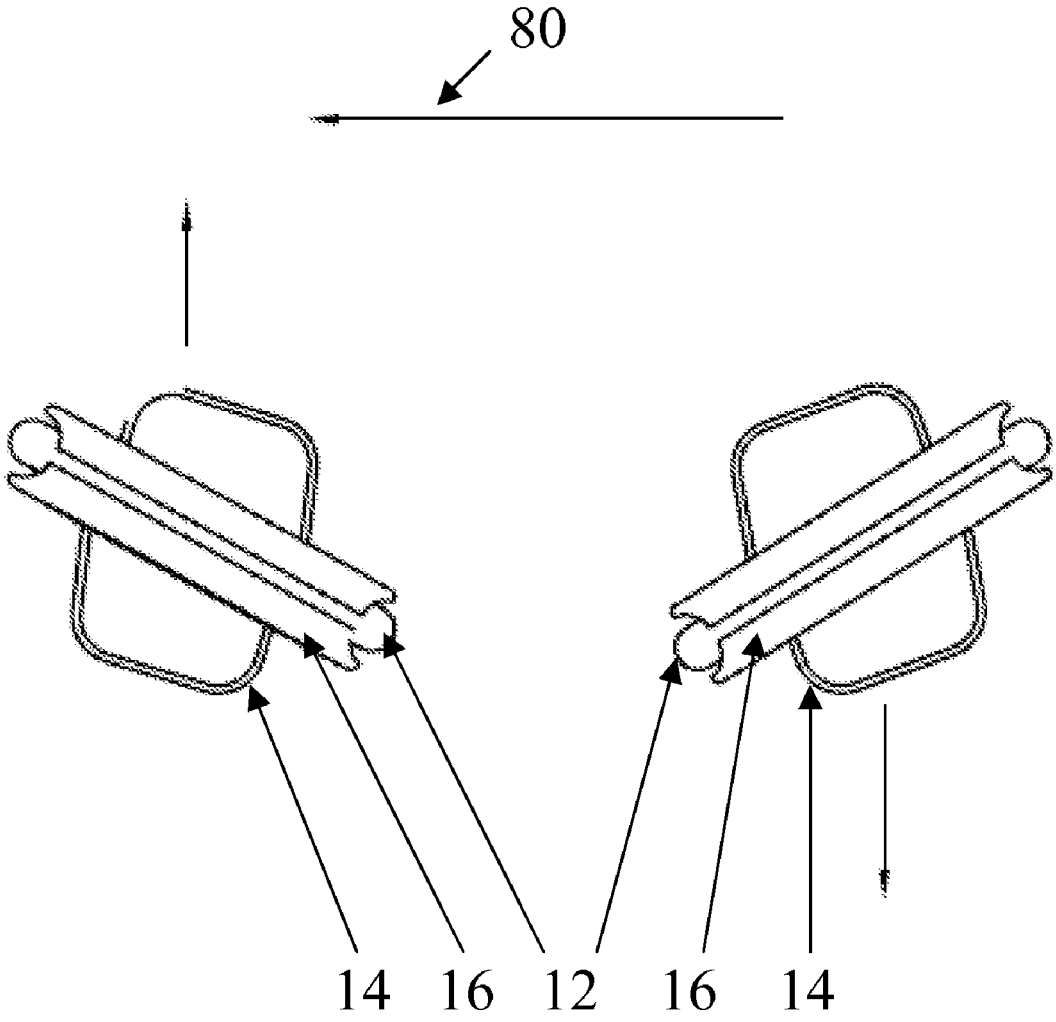

FIGS. 28 and 29 show the directional vectors imposed on two skate wheel devices in the situation where the user's feet point in a divergent manner in one case and where the user's feet point in a convergent manner in the other. The directional vectors are directed completely opposite each other.

Therefore, to move in the direction of travel indicated by the direction arrow 80, the user needs to swivel their feet in the sense of changing the relative pointing of the toes of both feet in unison so as to diverge outwardly in the manner of FIG. 27 and to converge inwardly in the manner of FIG. 28.

Figure 30:
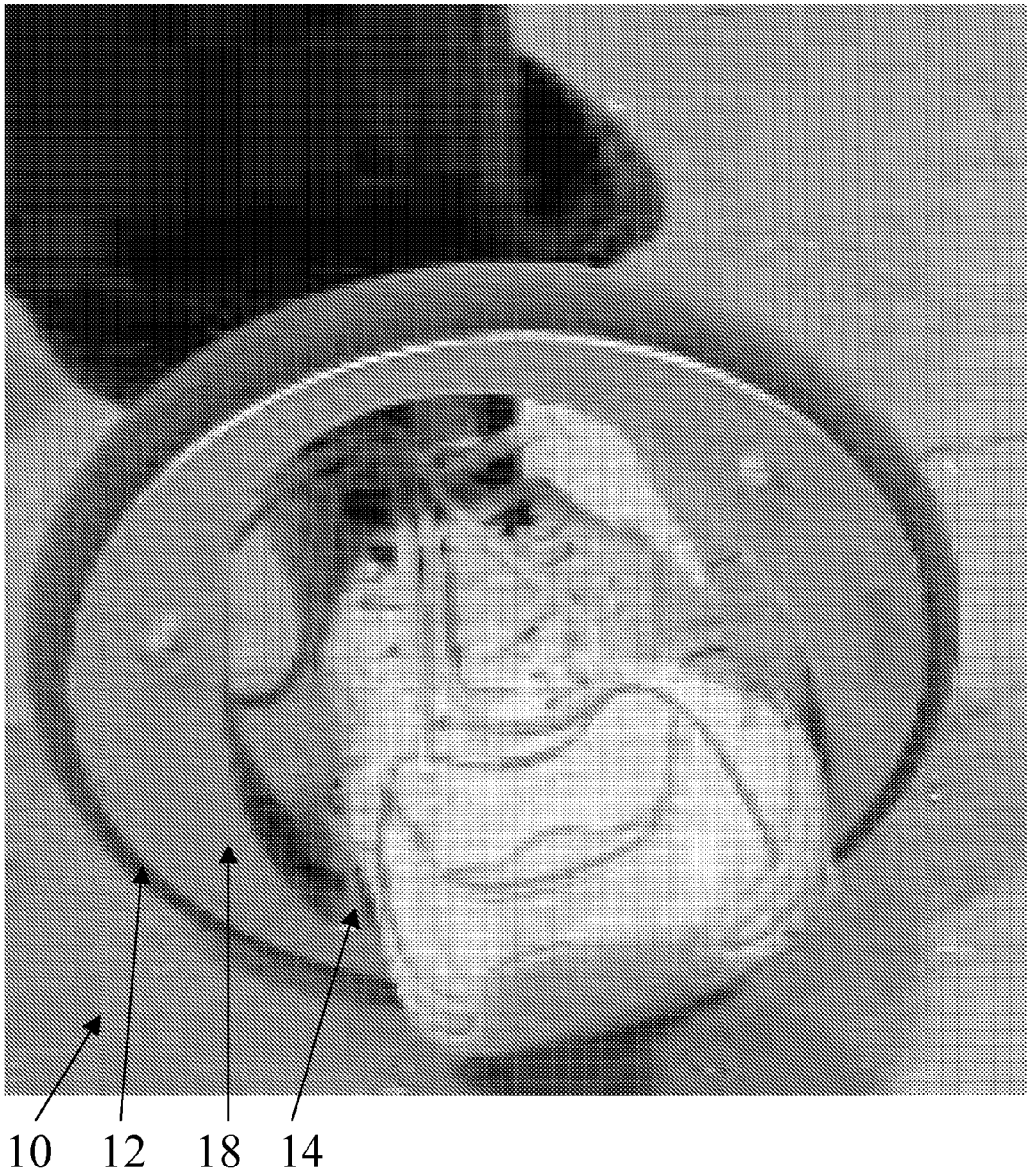
FIGS. 30-32 are progressive photographic isometric views of a wheel skate in accordance with the embodiment of FIGS. 15-17 that is undergoing tilting of the foot placement platform by moving the foot along a arc path.
Figure 31:
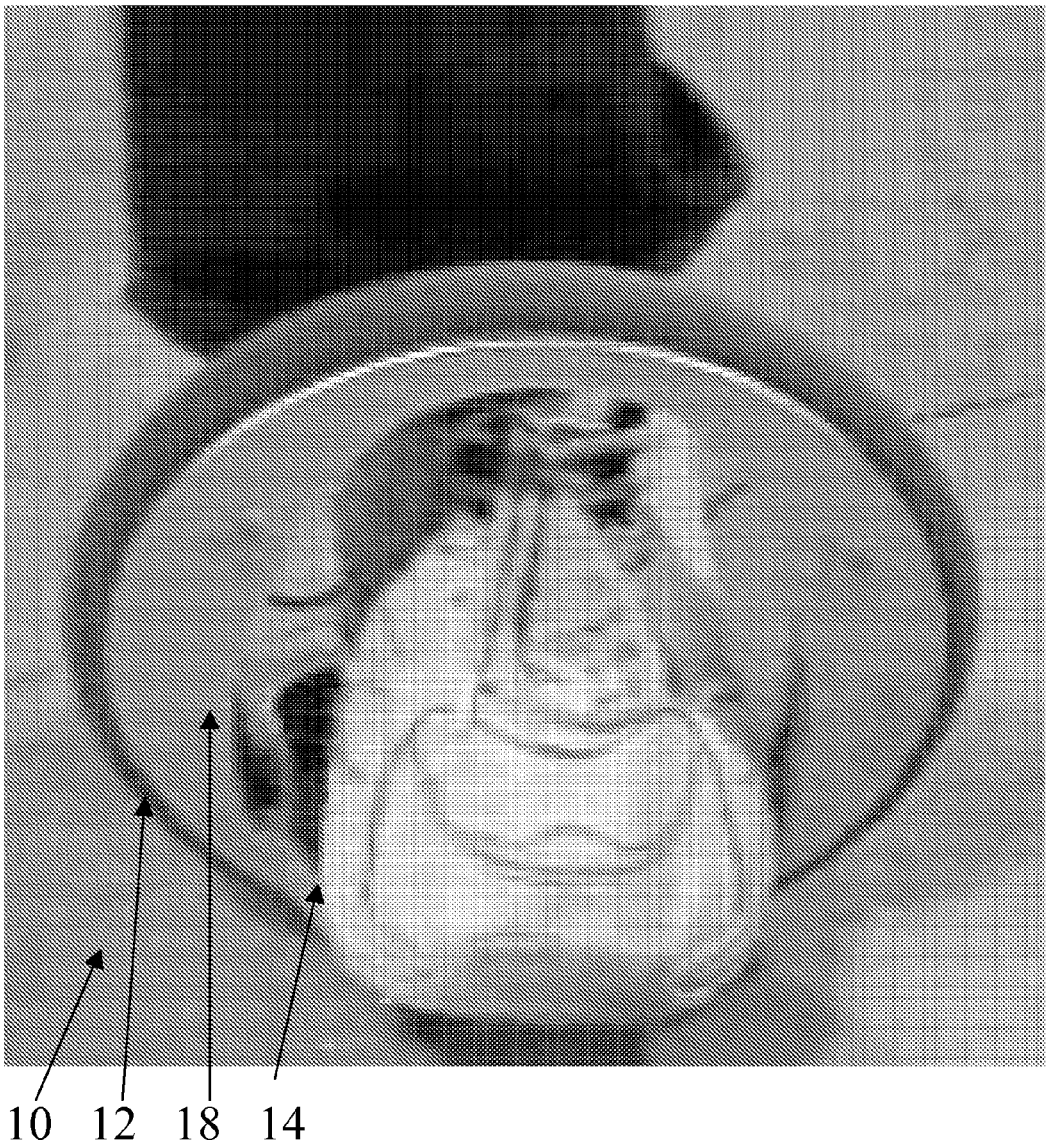
Figure 32:
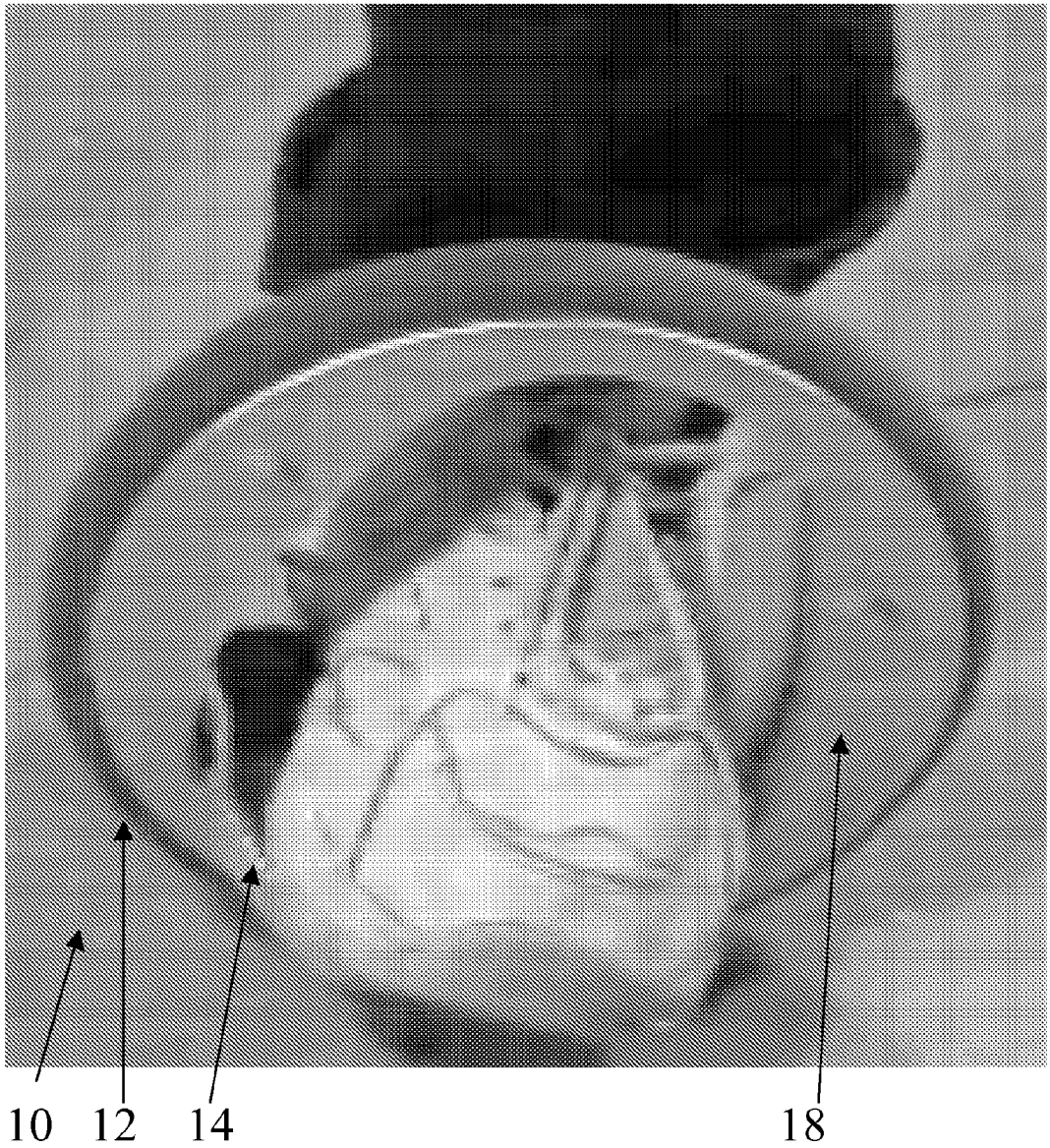

FIGS. 30-32 show progressive views of tilting of the foot placement platform 14 of one wheel skate 10, whose construction is that of the embodiment of FIG. 6. The user's foot can be seen traveling along an arc of movement from one side of the wheel skate to the other, i.e., rocking back and forth. As one can appreciate, after FIG. 31, the user's foot reverses direction to travel through the same arc of movement, but in the opposite direction. Thus, the sequence of tilt would be that of FIG. 30 to FIG. 31 to FIG. 32 back to FIG. 31 to FIG. 30. There are no inflexible constraints or impediments in the way that would substantially prevent or interfere with the free rocking back and forth, which is unlike the case if the two wheel skates were fixed together by a pivoted inelastic link.

Figure 33:
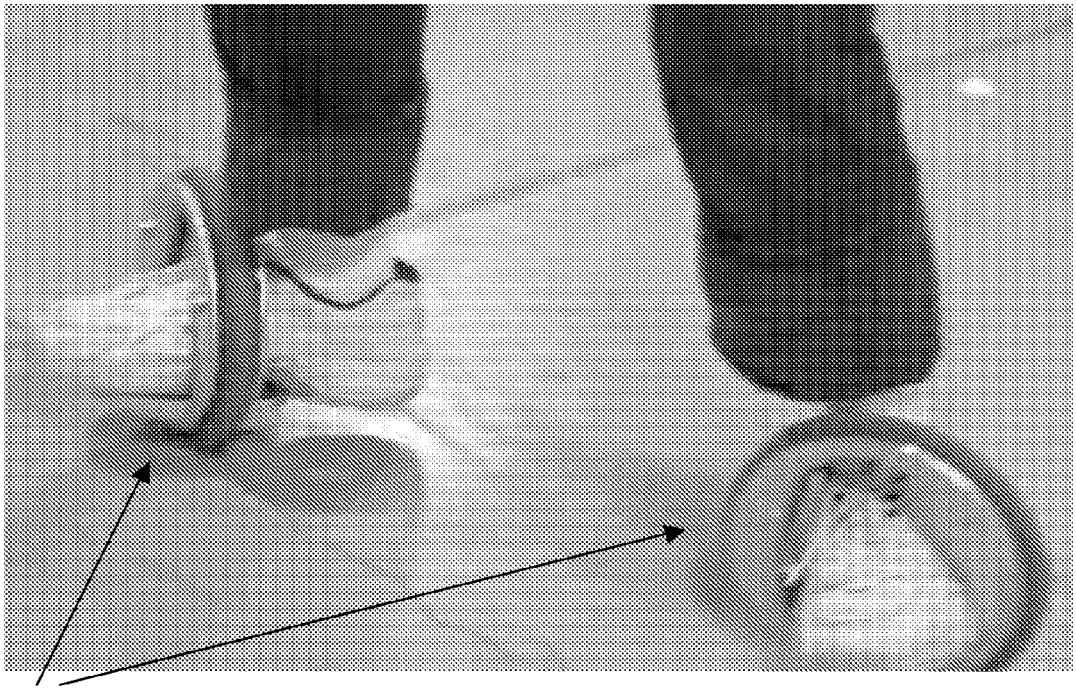
FIGS. 33 and 34 are progressive photographic isometric views of two wheels skates of the embodiment of FIG. 30-32 alternating between feet diverging and feet converging orientations to effect sideways rolling motion of the two skates.
Figure 34:
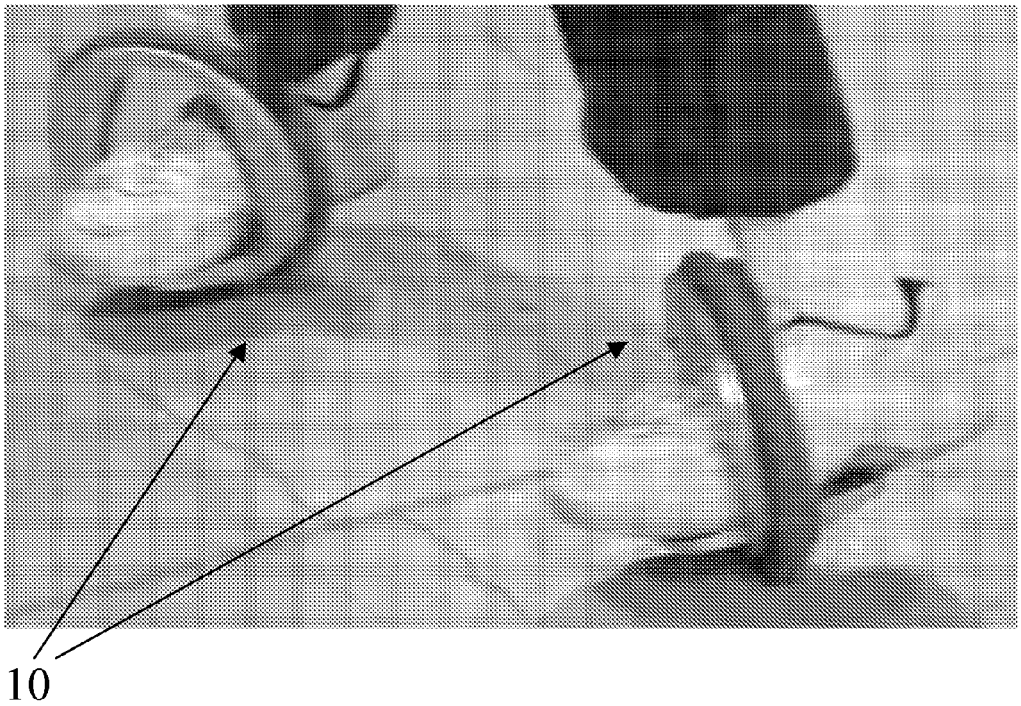

FIGS. 33 and 34 illustrate the movement of the feet to alternate between diverging and converging movements in the manner of FIGS. 28 and 29, respectively. That is, the toes of both feet point in unison in a diverging manner in FIG. 33 and in a converging manner in FIG. 34. Such arises from swiveling the feet while moving the feet separately in an alternating forward and backward motion. As a result, the two wheel skates may be directed to move in a generally sideways direction, albeit meandering to follow a winding course, i.e., a sideways path that twists.

Figure 35:
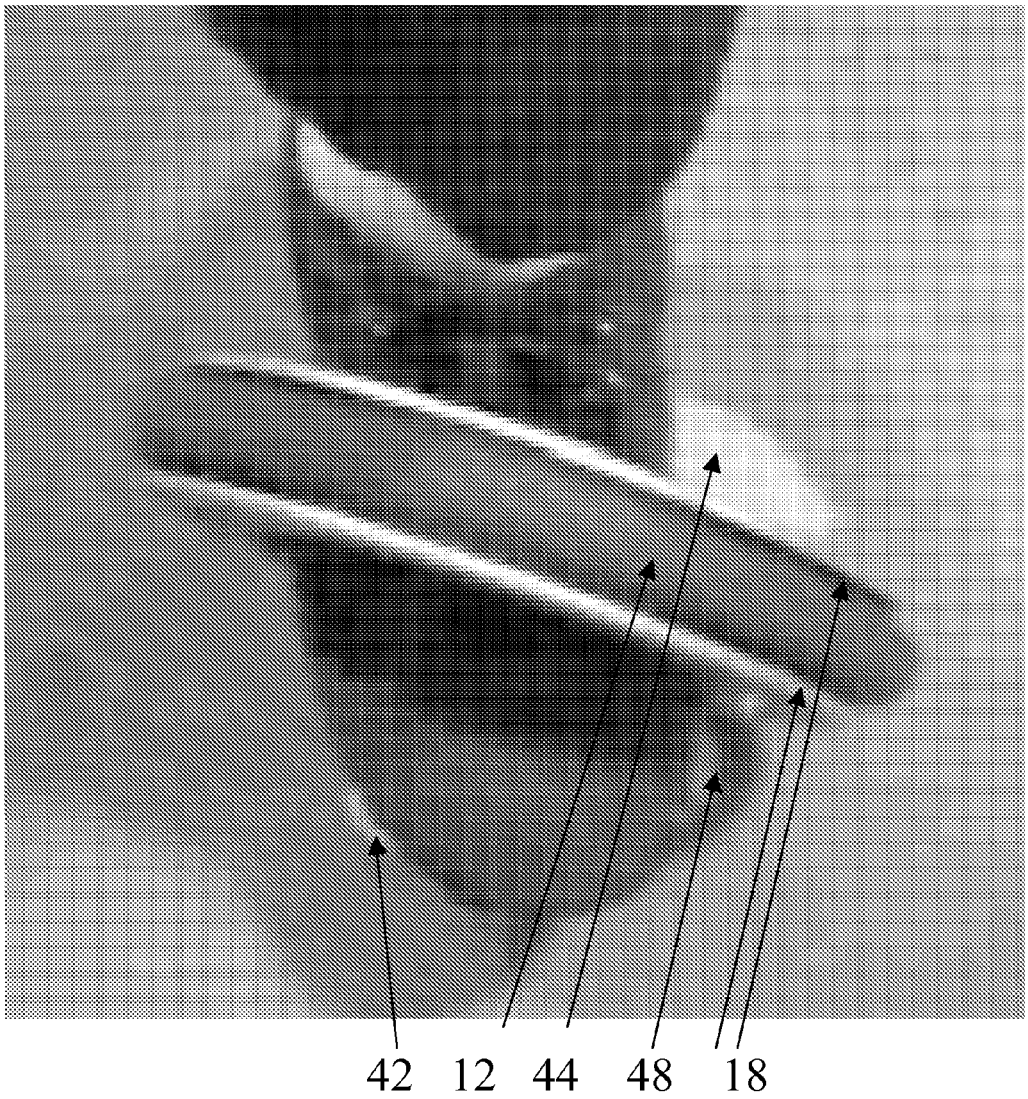
FIGS. 35-37 are progressive photographic isometric views of one wheel skate whose wheel is pivoting in accordance with the embodiment of FIG. 20.
Figure 36:
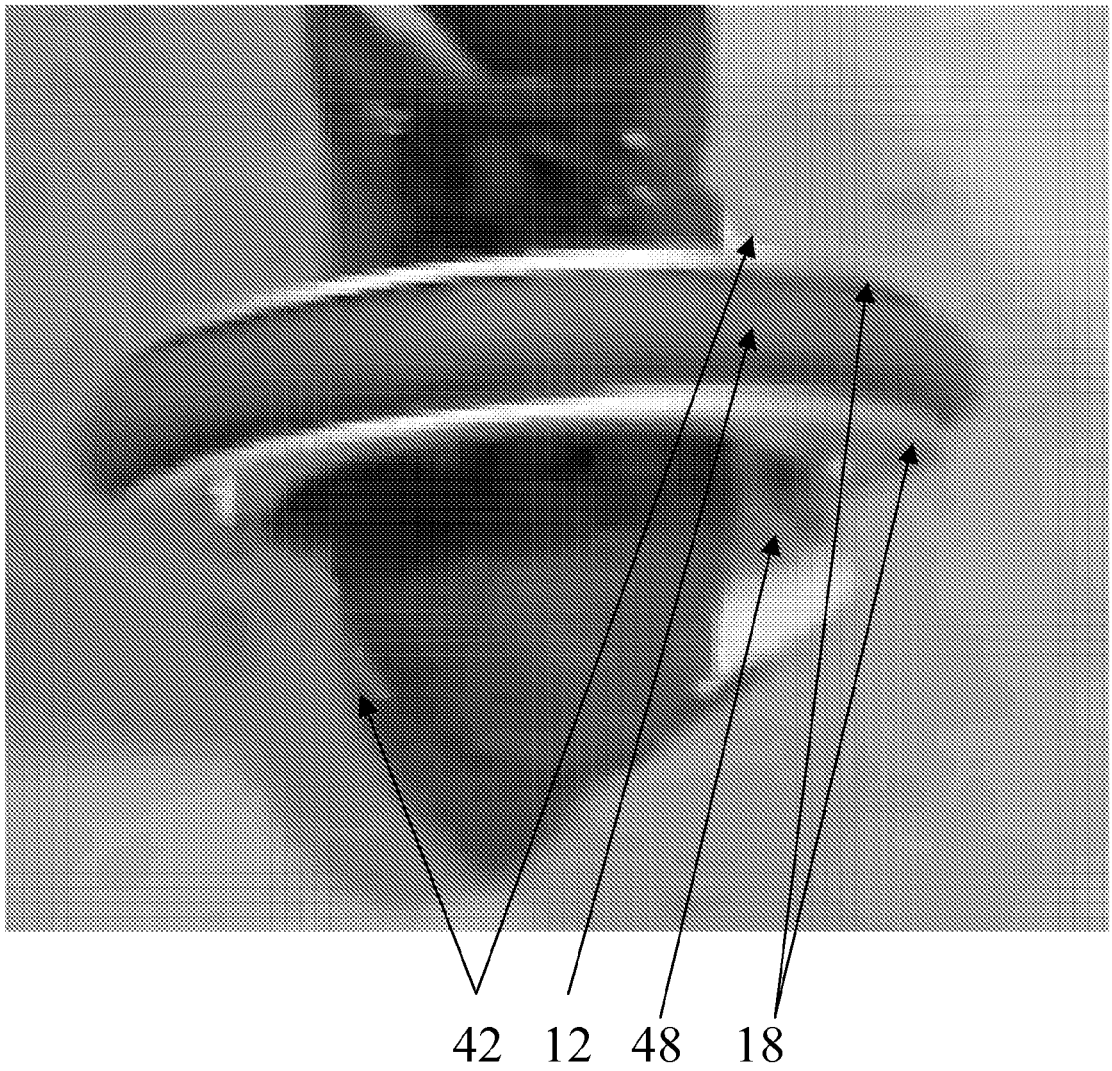
Figure 37:
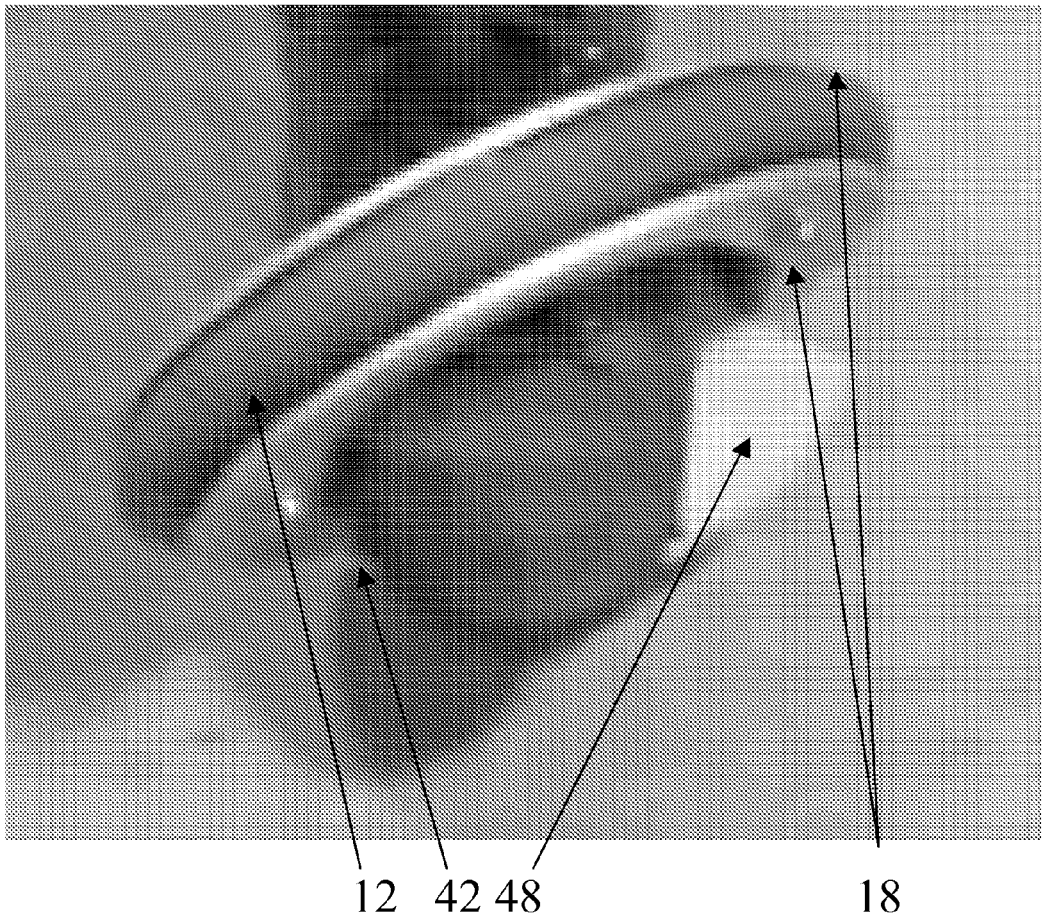

FIGS. 35-37 illustrate the caster-like movement of the wheel 12 relative to the frame 18 based on the embodiment of FIG. 20. The foot placement platform 48 is pivotally attached to an underlying grooved plate 42, which in turn is attached to the frame 18. As is evident from FIGS. 35-37, the wheel 12 swivels back and forth as it rolls in a generally forward or backward direction and changes its relative position, for instance, with respect to the user's foot on the foot placement platform 48.

In all the embodiments, the wheel 12 may be of a tire material molded to define a groove to guide the rollers 28, 30 during rotation of the wheel 12 or be equipped with an outer rim to which the tire material is secured. The outer rim may be metallic and have a groove to guide the rollers during rotation of the wheel. Further, the foot placement platform is free to rock back and forth relative to the wheel axis. That is, there is no structural impediment such as fixed or inelastic link between the two wheel skates that would prevent such rocking back and forth motion.

The foot placement platform 14 may be part of or substituted by the boot 62. Without a separate foot placement platform to attach to, the boot 62 would attach instead to the frame so that it is positioned centrally beneath the axial center of the wheel at a location corresponding to where the foot placement platforms are shown in the drawings. The attachment to the frame may be made in any conventional manner.

While the foregoing description and drawings represent the preferred embodiments of the invention, it will be understood that various changes and modifications may be made without departing from the scope of the present invention.

What is claimed is:

1. A wheel skate device, comprising:

a unit that includes a frame;

at least one wheel rotatable about a wheel axis within a plane of rotation;

rotary couplings arranged to guide rotation of the at least one wheel about the wheel axis; and a foot placement platform supported by the frame to define a platform surface that is elongated in a direction substantially transverse to the plane of rotation of the wheel and extends clear of the wheel axis, the foot placement platform being arranged free of any constraint that would otherwise substantially prevent the foot placement platform from rocking back and forth about the wheel axis relative to the at least one wheel;

wherein the foot placement platform is movable relative to the frame between a first in-use position and a second stowage position, the platform in the in-use position extending further from the plane of rotation than in the stowage position; and wherein in the stowage position, the platform is positioned substantially parallel to the plane of rotation.

2. A wheel skate device of claim 1, wherein the rotary couplings are in a form of grooved rollers supported by the frame to guide rotation of the at least one wheel about the wheel axis, the grooved rollers each having an encircling groove, the at least one wheel defining a track that fits in the encircling groove of each of the groove rollers so that as the wheel rotates about the wheel axis, the rollers rotate about respective roller axes.

3. A wheel skate device of claim 1, wherein the frame includes at least two frame elements; the at least one wheel being rotatable to turn about the wheel axis and relative to the at least two frame elements; the rotary couplings being in a form of rollers supported by and extending between the at least two frame elements to guide rotation of the at least one wheel about the wheel axis.

4. The wheel skate device of claim 1, wherein the rotary couplings include two sets of plurality of rollers, the plurality of rollers of one of the sets being arranged beneath an underside of the foot placement platform in a manner that is closer to each other than the plurality of rollers of the other set are to each other.

5. The wheel skate device of claim 1, wherein the foot placement platform is movable, yet non-releasably coupled to the frame for movement between the in-use position and the stowage position.

6. The wheel skate device of claim 1, wherein the platform surface is elongated in a direction of elongation to extend at an angle that is other than parallel to the wheel axis.

7. The wheel skate device of claim 1, 2, or 3, further comprising a plurality of guides arranged adjacent the foot placement platform to keep a user's foot centrally located on the foot placement platform, the guides being either adjustable in relative position to the frame to sandwich the user's foot between or having elastic material that squeezes the user's foot between.

8. The wheel skate device of claim 1, wherein the foot placement platform is either part of a boot that is attached to the frame or is attached to a boot.

9. The wheel skate device of claim 1, wherein the frame and platform are configured such that the frame and the platform in the stowage position define a gap substantially below the underside of a top portion of the frame and above the stowed platform that permits the ready insertion of a user's hand into that gap to hold the underside of the top portion of the frame to carry the device.

10. The wheel skate device of claim 9, wherein the outer lateral dimensions of the wheel and frame define an envelope, and the platform in the stowage position is positioned substantially within the envelope.

11. The wheel skate device of claim 1, further comprising a link extending outwardly from the unit or from a connector connected to the unit, the link being made of a material selected from a group consisting of a flexible material, elastic material and stretchable material.

12. A wheel skate device, comprising:

a platform;

a frame that encircles the platform during use; and a wheel supported by the frame that is rotatable about a wheel axis in a plane of rotation, the wheel encircling the foot of a user standing on the platform during use;

wherein the platform is movable relative to the frame between a first in-use position and a second stowage position, the platform in the in-use position extending further from the plane of rotation than in the stowage position; and wherein the frame and platform are configured such that the frame and the platform in the stowage position define a gap substantially below the underside of a top portion of the frame and above the stowed platform that permits the ready insertion of a user's hand into that gap to hold the underside of the top portion of the frame to carry the device.

13. The wheel skate device of claim 12, wherein in the in-use position, the platform extends substantially perpendicularly to the plane of rotation and, in the stowage position, the platform is positioned substantially parallel to the plane of rotation.

14. The wheel skate device of claim 12, wherein the platform in movable, yet non-releasably coupled to the frame for movement between the in-use and the stowage position.

15. The wheel skate device of claim 12, wherein the outer lateral dimensions of the wheel and frame define an envelope, and the platform in the stowage position is positioned substantially within that envelope.

16. A wheel skate device, comprising:

a platform;

a frame that encircles the platform during use; and a wheel supported by the frame that is rotatable about a wheel axis in a plane of rotation, the wheel encircling the foot of a user standing on the platform during use;

wherein the platform is movable relative to the frame between a first in-use position and a second stowage position, the platform in the in-use position extending further from the plane of rotation than in the stowage position; and wherein the outer lateral dimensions of the wheel and frame define an envelope, and the platform in the stowage position is positioned substantially within that envelope.

17. The device of claim 12, further comprising a plurality of rollers, some substantially under the platform and others not under the platform, positioned between the frame and wheel that support the rotatable movement of the wheel about the frame, the rollers substantially under the platform being arranged more densely than the rollers that are not substantially under the platform.

18. The device of claim 12, further comprising a plurality of rollers positioned between the frame and wheel that support the rotatable movement of the wheel about the frame, the rollers including a groove and the wheel including a track that fits into the groove for alignment of the wheel on the rollers and frame.

19. A wheel skate device, comprising:

a platform;

a frame that encircles the platform during use;

a wheel supported by the frame that is rotatable about a wheel axis in a plane of rotation, the wheel encircling the foot of a user standing on the platform during use; and a plurality of rollers, some substantially under the platform and others not under the platform, positioned between the frame and wheel that support the rotatable movement of the wheel about the frame, the rollers substantially under the platform being arranged more densely than the rollers that are not substantially under the platform;

wherein the platform is movable relative to the frame between a first in-use position and a second stowage position, the platform in the in-use position extending further from the plane of rotation than in the stowage position; and wherein the frame and platform are configured such that the frame and the platform in the stowage position define a gap substantially below the underside of a top portion of the frame and above the stowed platform that permits the ready insertion of a user's hand into that gap to hold the underside of the top portion of the frame to carry the device.

20. The device of claim 19, wherein in the stowage position the platform is positioned substantially parallel to the plane of rotation; and wherein the outer lateral dimensions of the wheel and frame define an envelope, and the platform in the stowage position is positioned substantially within that envelope.

21. The device of claim 19, wherein the platform in movable, yet non-releasably coupled to the frame for movement between the in-use position and the stowage position.

22. The wheel skate device of claim 16, wherein the frame and platform are configured such that the frame and the platform in the stowage position define a gap substantially below the underside of a top portion of the frame and above the stowed platform that permits the ready insertion of a user's hand into that gap to hold the underside of the top portion of the frame to carry the device.

23. A wheel skate device, comprising:

a platform;

a frame that encircles the platform during use; and a wheel supported by the frame that is rotatable about a wheel axis in a plane of rotation, the wheel encircling the foot of a user standing on the platform during use;

wherein the platform is movable relative to the frame between a first in-use position and a second stowage position, the platform in the in-use position extending further from the plane of rotation than in the stowage position; and wherein in the in-use position, the platform extends substantially perpendicularly to the plane of rotation and, in the stowage position, the platform is positioned in a manner that is more parallel than perpendicular to the plane of rotation.

* * * * *